US010173453B2

(12) United States Patent
Cape et al.

(10) Patent No.: US 10,173,453 B2
(45) Date of Patent: Jan. 8, 2019

(54) OPTICAL SECURITY DEVICE

(71) Applicant: Visual Physics, LLC, Alpharetta, GA (US)

(72) Inventors: Samuel M. Cape, Woodstock, GA (US); Jason van Gumster, Woodstock, GA (US)

(73) Assignee: Visual Physics, LLC, Alpharetta, GA (US)

( * ) Notice: Subject to any disclaimer, the term of this patent is extended or adjusted under 35 U.S.C. 154(b) by 142 days.

(21) Appl. No.: 14/772,563

(22) PCT Filed: Mar. 14, 2014

(86) PCT No.: PCT/US2014/028192
§ 371 (c)(1),
(2) Date: Sep. 3, 2015

(87) PCT Pub. No.: WO2014/143980
PCT Pub. Date: Sep. 18, 2014

(65) Prior Publication Data

US 2016/0009119 A1 Jan. 14, 2016

Related U.S. Application Data

(60) Provisional application No. 61/791,695, filed on Mar. 15, 2013.

(51) Int. Cl.
*B42D 25/328* (2014.01)
*B42D 25/29* (2014.01)
(Continued)

(52) U.S. Cl.
CPC ..... *B42D 25/328* (2014.10); *B42D 25/29* (2014.10); *B42D 25/373* (2014.10); *B42D 25/405* (2014.10)

(58) Field of Classification Search
CPC .. B42D 25/328; B42D 25/373; B42D 25/405; B42D 25/29
(Continued)

(56) References Cited

U.S. PATENT DOCUMENTS 992,151 A 5/1911 Berthon
1,824,353 A 9/1931 Jensen
(Continued)

FOREIGN PATENT DOCUMENTS

AU 2009278275 7/2012
CA 2741298 4/2010
(Continued)

OTHER PUBLICATIONS

Amidror, "A Generalized Fourier-Based Method for the Analysis of 2D Moiré Envelope-Forms in Screen Superpositions", Journal of Modern Optics (London, GB), vol. 41, No. 9, Sep. 1, 1994, pp. 1837-1862, ISSN: 0950-0340.
(Continued)

*Primary Examiner* — Justin V Lewis

(57) ABSTRACT

An improved form of optical security device for use in the protection of documents and articles of value from counterfeit and to verify authenticity is provided. The inventive device, which is made up of an optionally embedded array of icon focusing elements, at least one grayscale in-plane image, and a plurality of coextensive control patterns of icons contained on or within the in-plane image, each control pattern being mapped to areas of the grayscale in-plane image having a range of grayscale levels, provides enhanced design capability, improved visual impact, and greater resistance to manufacturing variations.

15 Claims, 13 Drawing Sheets

(51) Int. Cl.
*B42D 25/405* (2014.01)
*B42D 25/373* (2014.01)

(58) Field of Classification Search
USPC ..... 283/67, 72, 74, 93, 98, 901
See application file for complete search history.

(56) References Cited

U.S. PATENT DOCUMENTS 1,849,036 A 3/1932 Ernst
1,942,841 A 1/1934 Shimizu
2,268,351 A 12/1941 Tanaka
2,355,902 A 8/1944 Berg
2,432,896 A 12/1947 Hotchner
2,888,855 A 6/1959 Tanaka
2,992,103 A 7/1961 Land et al.
3,122,853 A 3/1964 Koonz et al.
3,241,429 A 3/1966 Rice et al.
3,264,164 A 8/1966 Jerothe et al.
3,312,006 A 4/1967 Rowland
3,357,772 A 12/1967 Rowland
3,357,773 A 12/1967 Rowland
3,463,581 A 8/1969 Clay
3,609,035 A 9/1971 Ataka
3,643,361 A 2/1972 Eaves
3,704,068 A 11/1972 Waly
3,801,183 A 4/1974 Sevelin et al.
3,811,213 A 5/1974 Eaves
3,887,742 A 6/1975 Reinnagel
4,025,673 A 5/1977 Reinnagel
4,073,650 A 2/1978 Yevick
4,082,426 A 4/1978 Brown
4,185,191 A 1/1980 Stauffer
4,345,833 A 8/1982 Siegmund
4,417,784 A 11/1983 Knop et al.
4,498,736 A 2/1985 Griffin
4,507,349 A 3/1985 Fromson et al.
4,519,632 A 5/1985 Parkinson et al.
4,534,398 A 8/1985 Crane
4,634,220 A 1/1987 Hockert et al.
4,645,301 A 2/1987 Orensteen et al.
4,662,651 A 5/1987 Mowry, Jr.
4,688,894 A 8/1987 Hockert
4,691,993 A 9/1987 Porter et al.
4,756,972 A 7/1988 Kloosterboer et al.
4,765,656 A 8/1988 Becker et al.
4,814,594 A 3/1989 Drexler
4,892,336 A 1/1990 Kaule et al.
4,892,385 A 1/1990 Webster, Jr. et al.
4,920,039 A 4/1990 Fotland et al.
4,935,335 A 6/1990 Fotland
4,988,126 A 1/1991 Heckenkamp et al.
5,044,707 A 9/1991 Mallik
5,074,649 A 12/1991 Hamanaka
5,085,514 A 2/1992 Mallik et al.
5,135,262 A 8/1992 Smith et al.
5,142,383 A 8/1992 Mallik
5,211,424 A 5/1993 Bliss
5,215,864 A 6/1993 Laakmann
5,232,764 A 8/1993 Oshima
5,254,390 A 10/1993 Lu
5,282,650 A 2/1994 Smith et al.
5,359,454 A 10/1994 Steenblik et al.
5,384,861 A 1/1995 Mattson et al.
5,393,099 A 2/1995 D'Amato
5,393,590 A 2/1995 Caspari
5,413,839 A 5/1995 Chatwin et al.
5,433,807 A 7/1995 Heckenkamp et al.
5,438,928 A 8/1995 Chatwin et al.
5,442,482 A 8/1995 Johnson et al.
5,449,200 A 9/1995 Andric et al.
5,460,679 A 10/1995 Abdel-Kader
5,461,495 A 10/1995 Steenblik et al.
5,464,690 A 11/1995 Boswell
5,468,540 A 11/1995 Lu
5,479,507 A 12/1995 Anderson
5,492,370 A 2/1996 Chatwin et al.
5,503,902 A 4/1996 Steenblik et al.
5,538,753 A 7/1996 Antes et al.
5,543,942 A 8/1996 Mizuguchi et al.
5,555,476 A 9/1996 Suzuki et al.
5,567,276 A 10/1996 Boehm et al.
5,568,313 A 10/1996 Steenblik et al.
5,574,083 A 11/1996 Brown et al.
5,575,507 A 11/1996 Yamauchi et al.
5,598,281 A 1/1997 Zimmerman et al.
5,623,347 A 4/1997 Pizzanelli
5,623,368 A 4/1997 Calderini et al.
5,626,969 A 5/1997 Jason
5,631,039 A 5/1997 Knight et al.
5,639,126 A 6/1997 Dames et al.
5,642,226 A 6/1997 Rosenthal
5,643,678 A 7/1997 Boswell
5,670,003 A 9/1997 Boswell
5,670,096 A 9/1997 Lu
5,674,580 A 10/1997 Boswell
5,688,587 A 11/1997 Burchard et al.
5,695,346 A 12/1997 Sekiguchi et al.
5,712,731 A 1/1998 Drinkwater et al.
5,723,200 A 3/1998 Oshima et al.
5,731,064 A 3/1998 Süss
5,737,126 A 4/1998 Lawandy
5,753,349 A 5/1998 Boswell
5,759,683 A 6/1998 Boswell
5,763,349 A 6/1998 Zandona
5,783,017 A 7/1998 Boswell
5,783,275 A 7/1998 Mück et al.
5,800,907 A 9/1998 Yumoto
5,810,957 A 9/1998 Boswell
5,812,313 A 9/1998 Johansen et al.
5,886,798 A 3/1999 Staub et al.
5,933,276 A 8/1999 Magee
5,949,420 A 9/1999 Terlutter
5,995,638 A 11/1999 Amidror et al.
6,030,691 A 2/2000 Burchard et al.
6,036,230 A 3/2000 Farber
6,036,233 A 3/2000 Braun et al.
6,060,143 A 5/2000 Tompkin et al.
6,084,713 A 7/2000 Rosenthal
6,089,614 A 7/2000 Howland et al.
6,106,950 A 8/2000 Searle et al.
6,176,582 B1 1/2001 Grasnick
6,177,953 B1 1/2001 Vachette et al.
6,179,338 B1 1/2001 Bergmann et al.
6,195,150 B1 2/2001 Silverbrook
6,249,588 B1 6/2001 Amidror et al.
6,256,149 B1 7/2001 Rolfe
6,256,150 B1 7/2001 Rosenthal
6,283,509 B1 9/2001 Braun et al.
6,288,842 B1 9/2001 Florczak et al.
6,297,911 B1 10/2001 Nishikawa et al.
6,301,363 B1 10/2001 Mowry, Jr.
6,302,989 B1 10/2001 Kaule
6,328,342 B1 12/2001 Belousov et al.
6,329,040 B1 12/2001 Oshima et al.
6,329,987 B1 12/2001 Gottfried et al.
6,345,104 B1 2/2002 Rhoads
6,348,999 B1 2/2002 Summersgill et al.
6,350,036 B1 2/2002 Hannington et al.
6,369,947 B1 4/2002 Staub et al.
6,373,965 B1 4/2002 Liang
6,381,071 B1 4/2002 Dona et al.
6,404,555 B1 6/2002 Nishikawa
6,405,464 B1 6/2002 Gulick, Jr. et al.
6,414,794 B1 7/2002 Rosenthal
6,424,467 B1 7/2002 Goggins
6,433,844 B2 8/2002 Li
6,450,540 B1 9/2002 Kim
6,467,810 B2 10/2002 Taylor et al.
6,473,238 B1 10/2002 Daniell
6,483,644 B1 11/2002 Gottfried et al.
6,500,526 B1 12/2002 Hannington
6,521,324 B1 2/2003 Debe et al.
6,542,646 B1 4/2003 Bar-Yona
6,558,009 B2 5/2003 Hannington et al.

(56) References Cited

U.S. PATENT DOCUMENTS 6,587,276 B2 7/2003 Daniell
6,616,803 B1 9/2003 Isherwood et al.
6,618,201 B2 9/2003 Nishikawa et al.
6,641,270 B2 11/2003 Hannington et al.
6,671,095 B2 12/2003 Summersgill et al.
6,712,399 B1 3/2004 Drinkwater et al.
6,721,101 B2 4/2004 Daniell
6,724,536 B2 4/2004 Magee
6,726,858 B2 4/2004 Andrews
6,751,024 B1 6/2004 Rosenthal
6,761,377 B2 7/2004 Taylor et al.
6,795,250 B2 9/2004 Johnson et al.
6,803,088 B2 10/2004 Kaminsky et al.
6,819,775 B2 11/2004 Amidror et al.
6,833,960 B1 12/2004 Scarbrough et al.
6,856,462 B1 2/2005 Scarbrough et al.
6,870,681 B1 3/2005 Magee
6,900,944 B2 5/2005 Tomczyk
6,926,764 B2 8/2005 Bleikolm et al.
6,935,756 B2 8/2005 Sewall et al.
7,030,997 B2 4/2006 Neureuther et al.
7,058,202 B2 6/2006 Amidror
7,068,434 B2 6/2006 Florczak et al.
7,114,750 B1 10/2006 Alasia et al.
7,194,105 B2 3/2007 Hersch et al.
7,246,824 B2 7/2007 Hudson
7,254,265 B2 8/2007 Naske et al.
7,255,911 B2 8/2007 Lutz et al.
7,288,320 B2 10/2007 Steenblik et al.
7,333,268 B2 2/2008 Steenblik et al.
7,336,422 B2 2/2008 Dunn et al.
7,359,120 B1 4/2008 Raymond et al.
7,372,631 B2 5/2008 Ozawa
7,389,939 B2 6/2008 Jones et al.
7,422,781 B2 9/2008 Gosselin
7,457,038 B2 11/2008 Dolgoff
7,457,039 B2 11/2008 Raymond et al.
7,468,842 B2 12/2008 Steenblik et al.
7,504,147 B2 3/2009 Hannington
7,545,567 B2 6/2009 Tomczyk
7,609,450 B2 10/2009 Niemuth
7,630,954 B2 12/2009 Adamczyk et al.
7,686,187 B2 3/2010 Pottish et al.
7,712,623 B2 5/2010 Wentz et al.
7,719,733 B2 5/2010 Schilling et al.
7,738,175 B2 6/2010 Steenblik et al.
7,744,002 B2 6/2010 Jones et al.
7,751,608 B2 7/2010 Hersch et al.
7,762,591 B2 7/2010 Schilling et al.
7,763,179 B2 7/2010 Levy et al.
7,812,935 B2 10/2010 Cowburn et al.
7,820,269 B2 10/2010 Staub et al.
7,830,627 B2 11/2010 Commander et al.
7,849,993 B2 12/2010 Finkenzeller et al.
8,027,093 B2 9/2011 Commander et al.
8,057,980 B2 11/2011 Dunn et al.
8,111,463 B2 2/2012 Endle et al.
8,149,511 B2 4/2012 Kaule et al.
8,241,732 B2 8/2012 Hansen et al.
8,284,492 B2 10/2012 Crane et al.
8,367,452 B2 2/2013 Soma et al.
8,514,492 B2 8/2013 Schilling et al.
8,528,941 B2 9/2013 Dörfler et al.
8,537,470 B2 9/2013 Endle et al.
8,557,369 B2 10/2013 Hoffmüller et al.
8,693,101 B2 4/2014 Tomczyk et al.
8,867,134 B2 10/2014 Steenblik et al.
8,908,276 B2 12/2014 Holmes
9,802,437 B2 10/2017 Holmes
2001/0048968 A1 12/2001 Cox et al.
2002/0014967 A1 2/2002 Crane et al.
2002/0114078 A1 8/2002 Halle et al.
2002/0167485 A1 11/2002 Hedrick
2002/0185857 A1 12/2002 Taylor et al.
2003/0031861 A1 2/2003 Reiter et al.
2003/0112523 A1 6/2003 Daniell
2003/0157211 A1 8/2003 Tsunetomo et al.
2003/0179364 A1 9/2003 Steenblik et al.
2003/0183695 A1 10/2003 Labrec et al.
2003/0228014 A1 12/2003 Alasia et al.
2003/0232179 A1 12/2003 Steenblik et al.
2003/0234294 A1 12/2003 Uchihiro et al.
2004/0020086 A1 2/2004 Hudson
2004/0022967 A1 2/2004 Lutz et al.
2004/0065743 A1 4/2004 Doublet
2004/0100707 A1 5/2004 Kay et al.
2004/0140665 A1 7/2004 Scarborough et al.
2004/0209049 A1 10/2004 Bak
2005/0094274 A1 5/2005 Souparis
2005/0104364 A1 5/2005 Keller et al.
2005/0161501 A1 7/2005 Giering et al.
2005/0180020 A1 8/2005 Steenblik et al.
2005/0247794 A1 11/2005 Jones et al.
2006/0003295 A1 1/2006 Hersch et al.
2006/0011449 A1 1/2006 Knoll
2006/0017979 A1 1/2006 Goggins
2006/0018021 A1 1/2006 Tompkins et al.
2006/0061267 A1 3/2006 Yamasaki et al.
2006/0227427 A1 10/2006 Dolgoff
2007/0058260 A1 3/2007 Steenblik et al.
2007/0092680 A1 4/2007 Chaffins et al.
2007/0164555 A1 7/2007 Mang et al.
2007/0183045 A1 8/2007 Shilling et al.
2007/0183047 A1 8/2007 Phillips et al.
2007/0273143 A1 11/2007 Crane et al.
2007/0284546 A1 12/2007 Ryzi et al.
2007/0291362 A1 12/2007 Hill et al.
2008/0130018 A1 6/2008 Steenblik et al.
2008/0143095 A1 6/2008 Isherwood et al.
2008/0160226 A1 7/2008 Kaule et al.
2008/0182084 A1 7/2008 Tompkin et al.
2009/0008923 A1 1/2009 Kaule et al.
2009/0061159 A1 3/2009 Staub et al.
2009/0243278 A1 10/2009 Camus et al.
2009/0261572 A1 10/2009 Bleikolm et al.
2009/0290221 A1 11/2009 Hansen et al.
2009/0310470 A1 12/2009 Yrjonen
2009/0315316 A1 12/2009 Staub et al.
2010/0001508 A1 1/2010 Tompkin et al.
2010/0018644 A1 1/2010 Sacks et al.
2010/0045024 A1 2/2010 Attner et al.
2010/0068459 A1 3/2010 Wang et al.
2010/0084851 A1 4/2010 Schilling
2010/0103528 A1 4/2010 Endle et al.
2010/0109317 A1 5/2010 Huffmuller et al.
2010/0177094 A1 7/2010 Kaule et al.
2010/0182221 A1 7/2010 Kaule et al.
2010/0194532 A1 8/2010 Kaule
2010/0208036 A1 8/2010 Kaule
2010/0277805 A1 11/2010 Schilling et al.
2010/0308571 A1 12/2010 Steenblik et al.
2010/0328922 A1 12/2010 Peters et al.
2011/0017498 A1 1/2011 Lauffer et al.
2011/0019283 A1 1/2011 Steenblik et al.
2011/0045255 A1 2/2011 Jones et al.
2011/0056638 A1 3/2011 Rosset
2011/0179631 A1 7/2011 Gates et al.
2012/0019607 A1 1/2012 Dunn et al.
2012/0033305 A1 2/2012 Moon et al.
2012/0091703 A1 4/2012 Maguire et al.
2012/0098249 A1 4/2012 Rahm et al.
2012/0194916 A1 8/2012 Cape et al.
2012/0243744 A1 9/2012 Camus et al.
2013/0003354 A1 1/2013 Meis et al.
2013/0010048 A1 1/2013 Dunn et al.
2013/0038942 A1 2/2013 Holmes
2013/0044362 A1 2/2013 Commander et al.
2013/0154250 A1 6/2013 Dunn et al.
2013/0154251 A1* 6/2013 Jolic ..... G02B 3/0006 283/85
2014/0174306 A1 6/2014 Wening et al.
2014/0175785 A1 6/2014 Kaule et al.
2014/0353959 A1 12/2014 Lochbihler
2014/0367957 A1 12/2014 Jordan

(56) References Cited

U.S. PATENT DOCUMENTS

| | | | |
|---|---|---|---|
| 2015/0152602 | A1 | 6/2015 | Blake et al. |
| 2016/0101643 | A1 | 4/2016 | Cape et al. |
| 2016/0176221 | A1 | 6/2016 | Holmes |
| 2016/0257159 | A1 | 9/2016 | Attner et al. |
| 2016/0325577 | A1 | 11/2016 | Jordan |
| 2017/0015129 | A1 | 1/2017 | Jordan |

FOREIGN PATENT DOCUMENTS

| | | |
|---|---|---|
| CN | 1102865 | 5/1995 |
| CN | 1126970 | 11/2003 |
| CN | 1950570 | 4/2007 |
| CN | 101678664 | 3/2010 |
| DE | 19804858 | 8/1999 |
| DE | 19932240 | 1/2001 |
| DE | 10100692 | 8/2004 |
| EP | 0090130 | 10/1983 |
| EP | 0092691 | 11/1983 |
| EP | 0118222 | 9/1984 |
| EP | 0156460 | 10/1985 |
| EP | 0203752 | 12/1986 |
| EP | 0253089 | 1/1988 |
| EP | 0318717 | 6/1989 |
| EP | 0415230 | 3/1991 |
| EP | 0319157 | 7/1992 |
| EP | 0801324 | 10/1997 |
| EP | 0887699 | 12/1998 |
| EP | 0930174 | 7/1999 |
| EP | 0997750 | 5/2000 |
| EP | 1356952 | 10/2003 |
| EP | 1002640 | 5/2004 |
| EP | 1538554 | 6/2005 |
| EP | 1354925 | 4/2006 |
| EP | 1659449 | 5/2006 |
| EP | 1743778 | 1/2007 |
| EP | 1801636 | 6/2007 |
| EP | 1876028 | 1/2008 |
| EP | 1897700 | 3/2008 |
| EP | 1931827 | 1/2009 |
| EP | 2335937 | 6/2011 |
| EP | 2338682 | 6/2011 |
| EP | 2162294 | 3/2012 |
| FR | 2803939 | 7/2001 |
| FR | 2952194 | 5/2011 |
| GB | 1095286 | 12/1967 |
| GB | 2103669 | 2/1983 |
| GB | 2168372 | 6/1986 |
| GB | 2227451 | 1/1990 |
| GB | 2362493 | 11/2001 |
| GB | 2395724 | 6/2004 |
| GB | 2433470 | 6/2007 |
| GB | 2490780 | 11/2012 |
| JP | 41-004953 | 3/1966 |
| JP | 46-022600 | 8/1971 |
| JP | 04-234699 | 8/1992 |
| JP | H05-508119 | 11/1993 |
| JP | 10-035083 | 2/1998 |
| JP | 10-039108 | 2/1998 |
| JP | 11-501590 | 2/1999 |
| JP | 11-189000 | 7/1999 |
| JP | 2000-056103 | 2/2000 |
| JP | 2000-233563 | 8/2000 |
| JP | 2000-256994 | 9/2000 |
| JP | 2001-055000 | 2/2001 |
| JP | 2001-516899 | 10/2001 |
| JP | 2001-324949 | 11/2001 |
| JP | 2003-039583 | 2/2003 |
| JP | 2003-165289 | 6/2003 |
| JP | 2003-528349 | 9/2003 |
| JP | 2003-326876 | 11/2003 |
| JP | 2004-262144 | 9/2004 |
| JP | 2004-317636 | 11/2004 |
| JP | 2005-193501 | 7/2005 |
| JP | 2009-274293 | 11/2009 |
| JP | 2011-502811 | 1/2011 |
| KR | 10-0194536 | 6/1999 |
| KR | 2002170350000 | 3/2001 |
| KR | 2003119050000 | 5/2003 |
| KR | 1005443000000 | 1/2006 |
| KR | 1005613210000 | 3/2006 |
| KR | 10-2008-0048578 | 6/2008 |
| RU | 2111125 | 5/1998 |
| RU | 2245566 | 1/2005 |
| RU | 2010101854 | 7/2011 |
| TW | 575740 | 2/2004 |
| WO | WO 1992/008998 | 5/1992 |
| WO | WO 1992/019994 | 11/1992 |
| WO | WO 1993/024332 | 12/1993 |
| WO | WO 1996/035971 | 11/1996 |
| WO | WO 1997/019820 | 6/1997 |
| WO | WO 1997/044769 | 11/1997 |
| WO | WO 1998/013211 | 4/1998 |
| WO | WO 1998/015418 | 4/1998 |
| WO | WO 1998/026373 | 6/1998 |
| WO | WO 1999/014725 | 3/1999 |
| WO | WO 1999/023513 | 5/1999 |
| WO | WO 1999/026793 | 6/1999 |
| WO | WO 1999/066356 | 12/1999 |
| WO | WO 2001/007268 | 2/2001 |
| WO | WO 2001/011591 | 2/2001 |
| WO | WO 2001/039138 | 6/2001 |
| WO | WO 2001/053113 | 7/2001 |
| WO | WO 2001/063341 | 8/2001 |
| WO | WO 2001/071410 | 9/2001 |
| WO | WO 2002/040291 | 5/2002 |
| WO | WO 2002/043012 | 5/2002 |
| WO | WO 2002/101669 | 12/2002 |
| WO | WO 2003/005075 | 1/2003 |
| WO | WO 2003/007276 | 1/2003 |
| WO | WO 2003/022598 | 3/2003 |
| WO | WO 2003/053713 | 7/2003 |
| WO | WO 2003/061980 | 7/2003 |
| WO | WO 2003/061983 | 7/2003 |
| WO | WO 2003/082598 | 10/2003 |
| WO | WO 2003/098188 | 11/2003 |
| WO | WO 2004/022355 | 3/2004 |
| WO | WO 2004/036507 | 4/2004 |
| WO | WO 2004/087430 | 10/2004 |
| WO | WO 2005/106601 | 11/2005 |
| WO | WO 2006/029744 | 3/2006 |
| WO | WO 2007/076952 | 7/2007 |
| WO | WO 2007/133613 | 11/2007 |
| WO | WO 2008/049632 | 5/2008 |
| WO | WO 2009/000527 | 12/2008 |
| WO | WO 2009/000528 | 12/2008 |
| WO | WO 2009/000529 | 12/2008 |
| WO | WO 2009/000530 | 12/2008 |
| WO | WO 2009/118946 | 10/2009 |
| WO | WO 2009/121784 | 10/2009 |
| WO | WO 2010/015383 | 2/2010 |
| WO | WO 2010/094961 | 8/2010 |
| WO | WO 2010/099571 | 9/2010 |
| WO | WO 2010/136339 | 12/2010 |
| WO | WO 2011/015384 | 2/2011 |
| WO | WO 2011/019912 | 2/2011 |
| WO | WO 2011/044704 | 4/2011 |
| WO | WO 2011/051669 | 5/2011 |
| WO | WO 2011/107793 | 10/2011 |
| WO | WO 2011/122943 | 10/2011 |
| WO | WO 2012/027779 | 3/2012 |
| WO | WO 2012027779 A1 * | 3/2012 ..... G02B 3/0006 |
| WO | WO 2012/103441 | 8/2012 |
| WO | WO 2013/028534 | 2/2013 |
| WO | WO 2013/093848 | 6/2013 |
| WO | WO 2013/098513 | 7/2013 |
| WO | WO 2016/063050 | 4/2016 |

OTHER PUBLICATIONS

Dunn, et al., "Three-Dimensional Virtual Images for Security Applications", Optical Security and Counterfeit Deterrence Techniques V, (published Jun. 3, 2004), Proc. SPIE 5310.

(56) References Cited

OTHER PUBLICATIONS

Muke, "Embossing of Optical Document Security Devices", Optical Security and Counterfeit Deterrence Techniques V, (published Jun. 3, 2004), Proc. SPIE 5310.
Article: "Spherical Lenses" (Jan. 18, 2009); pp. 1-12; retrieved from the Internet: URL:http://www.physicsinsights.org/simple_optics_spherical_lenses-1.html.
Drinkwater, K. John, et al., "Development and applications of Diffractive Optical Security Devices for Banknotes and High Value Documents", Optical Security and Counterfeit Deterrence Techniques III, 2000, pp. 66-79, SPIE vol. 3973, San Jose, CA.
Fletcher, D.A., et al., "Near-field infrared imaging with a microfabricated solid immersion lens", Applied Physics Letters, Oct. 2, 2000, pp. 2109-2111, vol. 77, No. 14.
Gale, M. T., et al., Chapter 6—Replication, Micro Optics: Elements, Systems and Applications, 1997, pp. 153-177.
Hardwick, Bruce and Ghioghiu Ana, "Guardian Substrate As An Optical Medium for Security Devices", Optical Security and Counterfeit Deterrence Techniques III, 2000, pp. 176-179, SPIE vol. 3973, San Jose, CA.
Hutley, M.C., et al., "The Moire Magnifier", Pure Appl. Opt. 3, 1994, pp. 133-142, IOP Publishing Ltd., UK.
Hutley, M.C., "Integral Photography, Superlenses and the Moire Magnifier", European Optical Society, 1993, pp. 72-75, vol. 2, UK.
Hutley, M., et al., "Microlens Arrays", Physics World, Jul. 1991, pp. 27-32.
Kamal, H., et al., "Properties of Moiré Magnifiers", Opt. Eng., Nov. 1998, pp. 3007-3014, vol. 37, No. 11.
Leech, Patrick W., et al., Printing via hot embossing of optically variable images in thermoplastic acrylic lacquer, Microelectronic Engineering, 2006, pp. 1961-1965, vol. 83, No. 10, Elsevier Publishers BV, Amsterdam, NL.
Lippmann, G., "Photgraphie—Épreuves Réversibles, Photographies Intégrals", Académie des Sciences, 1908, pp. 146-451, vol. 146, Paris.
Liu, S. et al. "Artistic Effects and Application of Moiré Patterns in Security Holograms", Applied Optics, Aug. 1995, pp. 4700-4702, vol. 34, No. 22.
Phillips, Roger W., et al., Security Enhancement of Holograms with Interference Coatings, Optical Security and Counterfeit Deterrence Techniques III, 2000, pp. 304-316, SPIE vol. 3973, San Jose, CA.
Steenblik, Richard A., et al., UNISON Micro-optic Security Film, Optical Security and Counterfeit Deterrence Techniques V, 2004, pp. 321-327, SPIE vol. 5310, San Jose, CA.
Van Renesse, Rudolf L., Optical Document Security, 1994, Artech House Inc., Norwood, MA.
Van Renesse, Rudolf L., Optical Document Security, 1998, 2nd edition, pp. 232-235, 240-241 and 320-321, Artech House Inc., Norwood, MA (ISBN 0-89006-982-4).
Van Renesse, Rudolf L., Optical Document Security, 2005, 3rd edition, pp. 62-169, Artech House Inc., Norwood, MA (ISBN 1-58053-258-6).
Wolpert, Gary R., Design and development of an effective optical variable device based security system incorporating additional synergistic security technologies, Optical Security and Counterfeit Deterrence Techniques III, 2000, pp. 55-61, SPIE vol. 3973, San Jose, CA.
Zhang, X., et al., "Concealed Holographic Coding for Security Applications by Using a Moiré Technique", Applied Optics, Nov. 1997, pp. 8096-8097, vol. 36, No. 31.

* cited by examiner

OPTICAL SECURITY DEVICE

RELATED APPLICATION

This application claims priority to U.S. Provisional Patent Application Ser. No. 61/791,695, filed Mar. 15, 2013, which is incorporated herein in its entirety by reference.

TECHNICAL FIELD

This invention relates to an improved form of optical security device for use in the protection of documents and articles of value from counterfeit and to verify authenticity. More specifically, this invention relates to an optical security device that provides enhanced design capability, improved visual impact, and greater resistance to manufacturing variations.

BACKGROUND AND SUMMARY OF THE INVENTION

Micro-optic film materials projecting synthetic images generally comprise: an arrangement of micro-sized image icons; an arrangement of focusing elements (e.g., microlenses, microreflectors); and optionally, a light-transmitting polymeric substrate. The image icon and focusing element arrangements are configured such that when the arrangement of image icons is viewed using the arrangement of focusing elements, one or more synthetic images are projected. These projected images may show a number of different optical effects.

Such film materials may be used as security devices for authentication of banknotes, secure documents and products. For banknotes and secure documents, these materials are typically used in the form of a strip, patch, or thread and can be either partially or completely embedded within the banknote or document, or applied to a surface thereof. For passports or other identification (ID) documents, these materials could be used as a full laminate or inlayed in a surface thereof. For product packaging, these materials are typically used in the form of a label, seal, or tape and are applied to a surface thereof.

One example of a micro-optic security device is known from U.S. Pat. No. 7,738,175, which reveals a micro-optic system that embodies (a) an in-plane image having a boundary and an image area within the boundary that is carried on and visually lies in the plane of a substrate, (b) a control pattern of icons contained within the boundary of the in-plane image, and (c) an array of icon focusing elements. The icon focusing element array is positioned to form at least one synthetically magnified image of the control pattern of icons, the synthetically magnified image providing a limited field of view for viewing the in-plane image operating to modulate the appearance of the in-plane image. In other words, the appearance of the in-plane image visually appears and disappears, or turns on and off, depending upon the viewing angle of the system.

Several drawbacks in this micro-optic system become evident when used in a sealed lens format (i.e., a system utilizing an embedded lens array). First, when the synthetic image is in its "off" state a slight ghost image of the synthetic image may remain visible because of light scattered through or around the focusing optics. These ghost images are especially pronounced in the sealed lens format. Second, the sealed lens format has a relatively high f-number, typically around 2. As will be readily appreciated by one skilled in the field of micro-optics, a higher f-number leads to more rapid movement of synthetic images, but also increases blurriness and the system's sensitivity to manufacturing variations. These drawbacks effectively render this system unsuitable for use in a sealed lens format.

The present invention addresses these drawbacks by providing an optical security device, which comprises:

an optionally embedded array of icon focusing elements;

at least one grayscale in-plane image that visually lies substantially in a plane of a substrate on which the in-plane image is carried; and a plurality of coextensive (intermingled) control patterns of icons contained on or within the at least one in-plane image forming an icon layer, each control pattern being mapped to areas of the in-plane image having a range of grayscale levels, wherein placement of the control patterns of icons within the in-plane image is determined using one or more control pattern probability distributions associated with each grayscale level within all or part of the in-plane image, wherein the array of icon focusing elements is positioned to form at least one synthetically magnified image of at least a portion of the icons in each coextensive control pattern of icons, the at least one synthetically magnified image (which intersects with the at least one in-plane image) having one or more dynamic effects, wherein the one or more dynamic effects of the at least one synthetically magnified image are controlled and choreographed by the control patterns of icons.

As the optical security device is tilted the synthetically magnified images demonstrate dynamic optical effects in the form of, for example, dynamic bands of rolling color running through the in-plane image, growing concentric circles, rotating highlights, strobe-like effects, pulsing text, pulsing images, rolling parallel or non-parallel lines, rolling lines that move in opposite directions but at the same rate, rolling lines that move in opposition directions but at different or spatially varying rates, bars of color that spin around a central point like a fan, bars of color that radiate inward or outward from a fixed profile, embossed surfaces, engraved surfaces, as well as animation types of effects such as animated figures, moving text, moving symbols, animated abstract designs that are mathematical or organic in nature, etc. Dynamic optical effects also include those optical effects described in U.S. Pat. No. 7,333,268 to Steenblik et al., U.S. Pat. No. 7,468,842 to Steenblik et al., and U.S. Pat. No. 7,738,175 to Steenblik et al., all of which, as noted above, are fully incorporated by reference as if fully set forth herein.

In an exemplary embodiment, one or more layers of metallization cover an outer surface of the icon layer.

By way of the inventive optical security device, the synthetically magnified image(s) of the in-plane image(s) is always 'on'. In one exemplary embodiment, as the device is tilted synthetically magnified images in the form of bands of color sweep over the surface of the in-plane image, revealing tremendous detail (i.e., improved visual impact). The bands of color are 'choreographed' using the multiple control patterns of icons. The 'ghost image', which is troublesome for the micro-optic system of U.S. Pat. No. 7,738,175, helps the optical effects of the present invention to be more convincing by providing a silhouette of the in-plane image at every tilt angle that can always be seen. Also, because the image never turns 'off', and is visually defined by the choreographed optical effects (e.g., bands of rolling color), the in-plane image may be made much larger thereby providing enhanced design capability. In addition, the inventive device is less sensitive to manufacturing variations.

While any such manufacturing variation may serve to change the angle and shape of the synthetic images, the relative choreography will remain the same, and thus the effect will not be disturbed to the same extent as the prior art system.

The present invention also provides a method for making the optical security device described above, the method comprising:

(a) providing at least one grayscale in-plane image that visually lies substantially in a plane of a substrate on which the in-plane image is carried;

(b) providing a plurality of coextensive (intermingled) control patterns of icons contained on or within the at least one in-plane image forming an icon layer, each control pattern being mapped to areas of the in-plane image having a range of grayscale levels, wherein placement of the control patterns of icons within the in-plane image is determined using one or more control pattern probability distributions associated with each grayscale level within all or part of the in-plane image;

(c) providing an optionally embedded array of icon focusing elements; and (d) positioning the optionally embedded array of icon focusing elements relative to the icon layer so as to form at least one synthetically magnified image of at least a portion of the icons in each coextensive control pattern of icons, the at least one synthetically magnified image (which intersects with the at least one in-plane image) having one or more dynamic effects, wherein the one or more dynamic effects of the at least one synthetically magnified image are controlled and choreographed by the control patterns of icons.

In an exemplary embodiment of the inventive optical security device, the device includes a grayscale in-plane image, a plurality of control patterns of icons contained within the in-plane image thereby forming an icon layer, and an array of icon focusing elements positioned to form at least one synthetically magnified image of the control patterns of icons. The method for forming the icon layer in this exemplary embodiment comprises: selecting a grayscale in-plane image; and using the grayscale in-plane image to drive placement of the control patterns of icons within the in-plane image to form the icon layer.

In an exemplary embodiment, the inventive method comprises:

(a) selecting a grayscale in-plane image and scaling the grayscale image to a size suitable for use in the icon layer (e.g., several square millimeters to several square centimeters);

(b) superimposing a tiling onto the scaled grayscale in-plane image, the tiling comprising cells that will contain the control patterns of icons, wherein each cell has a preferred size similar to one or several focusing elements (e.g., several microns to tens of microns);

(c) selecting a numerical range to represent the colors black and white and the various levels of gray in between black and white (e.g., 0 for black, 1 for white, and the continuum of real numbers in between as representing the various levels of gray);

(d) determining the level of grayscale of the scaled grayscale in-plane image in each cell of the superimposed tiling;

(e) assigning to each cell a number which represents the determined level of grayscale and which falls within the selected numerical range (e.g., 0-1), wherein the assigned number is the cell's grayscale value;

(f) selecting a number of control patterns of icons for use in a control pattern palette, and for each control pattern of icons, assigning a range of grayscale levels which fall within the selected numerical range;

(g) specifying a control pattern probability distribution within the in-plane image and for each possible grayscale value, using the control pattern probability distribution to assign a range of random numbers to each control pattern;

(h) providing each cell in the tiling with a random number that falls with the selected numerical range (e.g., 0-1) using a Random Number Generator (RNG);

(i) determining which control pattern will be used to fill each cell using the cell's grayscale value and the cell's random number in conjunction with a mathematical construct which corresponds to the control pattern probability distribution; and (j) filling each cell with its determined control pattern of icons.

In another exemplary embodiment of the inventive optical security device, the device includes a sequence of grayscale in-plane images, a set of control patterns of icons for each in-plane image, wherein each set of control patterns of icons is contained within its respective in-plane image, which together form an icon layer, and an array of icon focusing elements positioned to form an animation of the synthetically magnified images of the control patterns of icons. The method for forming the icon layer in this exemplary embodiment comprises: selecting a sequence of grayscale in-plane images, selecting a set of control patterns of icons for each grayscale in-plane image; and using the grayscale in-plane images to drive placement of its respective control patterns of icons within the in-plane image to together form the icon layer.

In an exemplary embodiment, the inventive method comprises:

(a) selecting a sequence of grayscale in-plane images that form an animation and scaling the grayscale images to a size suitable for use in the icon layer (e.g., several square millimeters to several square centimeters);

(b) superimposing a tiling onto each scaled grayscale in-plane image, the tiling comprising cells that will contain the control patterns of icons, wherein each cell has a preferred size similar to one or several focusing elements (e.g., several microns to tens of microns);

(c) selecting a numerical range to represent the colors black and white and the various levels of gray in between black and white (e.g., 0 for black, 1 for white, and the continuum of real numbers in between as representing the various levels of gray);

(d) determining the level of grayscale of the scaled grayscale in-plane image in each cell of the superimposed tiling;

(e) assigning to each cell a number which represents the determined level of grayscale and which falls within the selected numerical range (e.g., 0-1), wherein the assigned number is the cell's grayscale value;

(f) for each grayscale in-plane image that forms the animation, selecting a number of control patterns of icons for use in a control pattern palette, and for each control pattern of icons, assigning a range of grayscale levels which fall within the selected numerical range, wherein the selected number of control patterns of icons constitutes a set of control patterns for the grayscale in-plane image, with each grayscale in-plane image having one set of control patterns of icons;

(g) specifying, for each set of control patterns of icons, a control pattern probability distribution within the respective in-plane image and for each possible grayscale value, using the control pattern probability distribution to assign a range of random numbers to each control pattern;

(h) providing each cell in the tiling with a random number that falls with the selected numerical range (e.g., 0-1) using an RNG;

(i) determining, for each set of control patterns, each set being assigned to a specific and different grayscale image, which control pattern will be used to fill each cell using the cell's grayscale value and the cell's random number in conjunction with a mathematical construct which corresponds to the control pattern probability distribution; and (j) filling each cell with its determined control pattern of icons, each cell receiving a determined control pattern from each set of control patterns of icons.

The present invention further provides a method for increasing design space, reducing sensitivity to manufacturing variations, and reducing blurriness of images formed by an optical security device, the optical security device including at least one in-plane image, a plurality of control patterns of icons contained within the in-plane image forming an icon layer, and an array of icon focusing elements positioned to form at least one synthetically magnified image of the control patterns of icons, the method comprising: using at least one grayscale in-plane image; and using coordinated control patterns of icons on or within the in-plane image to control and choreograph one or more dynamic effects of the synthetically magnified images.

The present invention further provides sheet materials and base platforms that are made from or employ the inventive optical security device, as well as documents made from these materials.

In an exemplary embodiment, the inventive optical security device is a micro-optic film material such as an ultra-thin (e.g., a thickness ranging from about 1 to about 10 microns), sealed lens structure for use in banknotes.

In another exemplary embodiment, the inventive optical security device is a sealed lens polycarbonate inlay for base platforms used in the manufacture of plastic passports.

Other features and advantages of the invention will be apparent to one of ordinary skill from the following detailed description and accompanying drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods/processes, and examples are illustrative only and not intended to be limiting.

BRIEF DESCRIPTION OF THE DRAWINGS

The present disclosure may be better understood with reference to the following drawings. Components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications and equivalents.

Particular features of the disclosed invention are illustrated by reference to the accompanying drawings in which:

FIG. 1A illustrates an exemplary embodiment of a grayscale in-plane image used in the practice of the present invention, while

DETAILED DESCRIPTION OF THE INVENTION

By way of the optical security device of the present invention, a new platform for giving very detailed images is provided. As mentioned above, the inventive device provides enhanced design capability, improved visual impact, and greater resistance to manufacturing variations.

The two exemplary embodiments of the inventive optical security device described above will now be depicted in more detail below in conjunction with the drawings.

In-Plane Image

The in-plane image of the inventive optical security device is an image that has some visual boundary, pattern, or structure that visually lies substantially in the plane of the substrate on which or in which the in-plane image is carried.

Figure 1A:
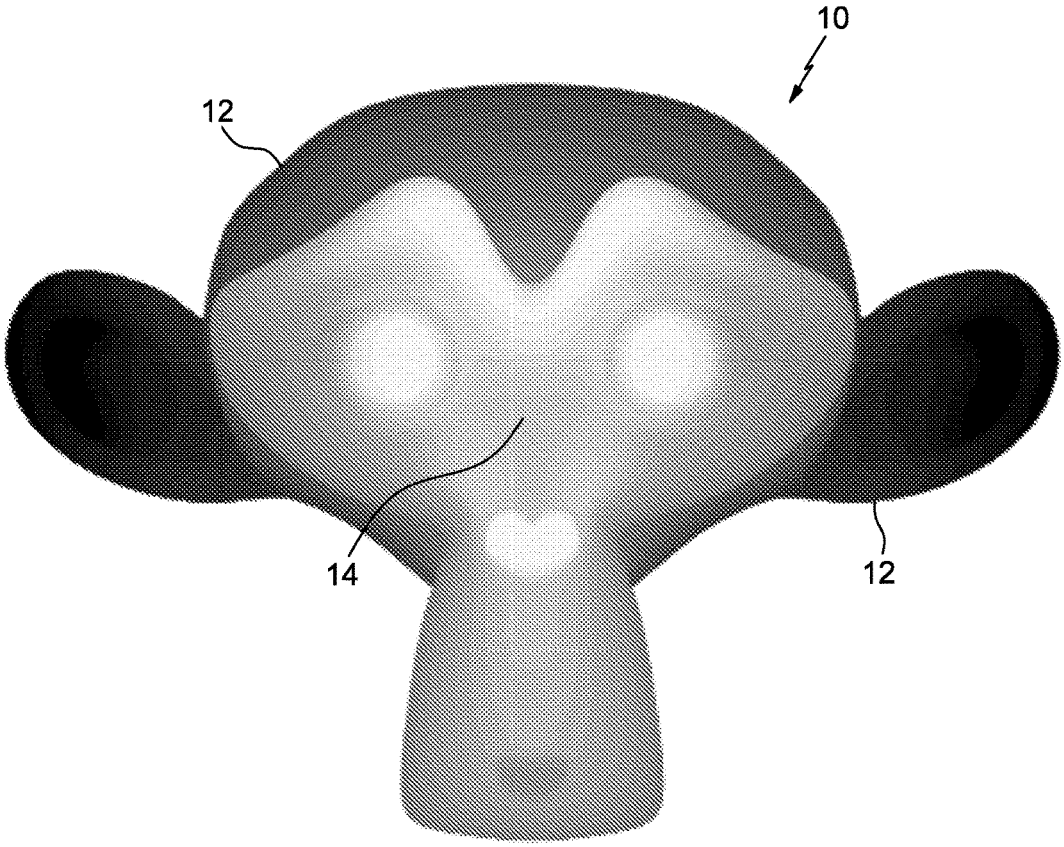

In FIG. 1A, an exemplary embodiment of a grayscale in-plane image in the form of a monkey's face is marked with reference numeral 10. Grayscale in-plane image 10, which is simply an image in which the only colors are shades of gray (i.e., shades from black to white), has a boundary 12 and an image area 14 within the boundary that, as noted above, visually lies substantially in a plane of a substrate on which the in-plane image 10 is carried. In this exemplary embodiment, the grayscale image was made so that the parts that seem 'closest' to the viewer (the eyes and nose) are whitest, while the parts that seem 'farthest away' from the viewer are darkest.

When forming the icon layer of the inventive optical security device, a single grayscale image (such as that shown in FIG. 1A) is chosen and scaled to the 'actual size' that it should be in physical form. In one exemplary embodiment, the image is scaled to a size ranging from about several square millimeters to about several square centimeters. This is typically much larger than the focusing elements, which in terms of microlenses typically having a size on the order of microns or tens of microns.

Figure 1B:
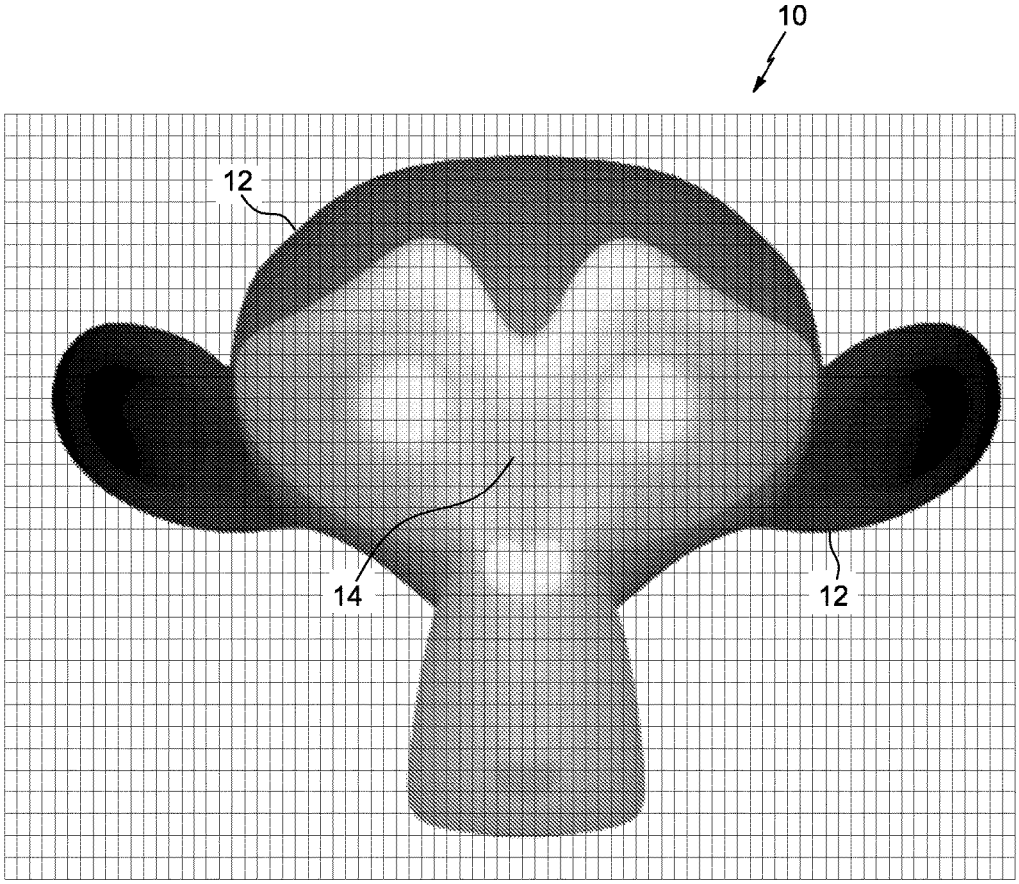
FIG. 1B illustrates a tiling superimposed onto the grayscale in-plane image of FIG. 1A.

Next, as best shown in FIG. 1B, a tiling 16 is superimposed onto the grayscale image 10. This tiling 16 represents cells that will contain the control patterns of icons. The size of each cell is not limited, but in an exemplary embodiment, is on the order of the size of one or several focusing elements (e.g., from several microns to tens of microns). While rectangular-shaped cells are shown in FIG. 1B, any variety of shapes that form a tessellation can be used (e.g., parallelograms, triangles, regular or non-regular hexagons, or squares).

A numerical range is then selected to represent the colors black and white and the various levels of gray in between black and white. Some methods map black to 0 and white to 255, and the levels of gray to the integers in between (e.g., in 8-bit grayscale images), while some methods use larger ranges of numbers (e.g., in 16 or 32 bit grayscale images). In the present exemplary embodiment, however, for simplicity, 0 is used for black and 1 is used for white and the continuum of real numbers in between 0 and 1 is used to represent the various levels of gray.

Figure 2:
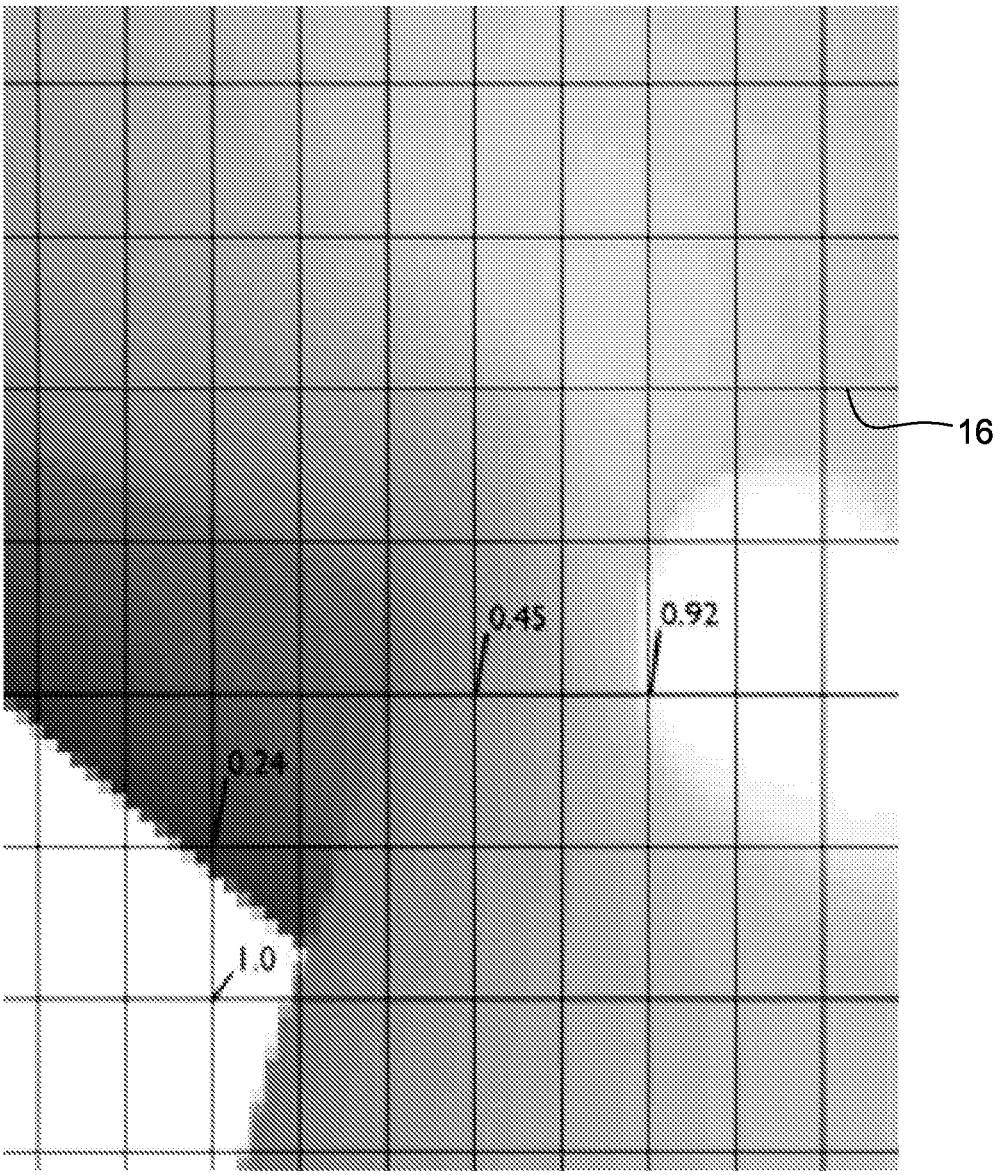
FIG. 2 illustrates an enlarged portion of the tiled grayscale in-plane image of FIG. 1A, showing grayscale levels of the in-plane image measured at the lower-left corner of four rectangular tiles or cells.

The level of grayscale at the location of each cell in the grayscale image 10 is then determined. For example, and as best shown in FIG. 2, for each cell, a common point is chosen (e.g., the lower-left corner of each rectangular tile or cell) and the level of grayscale of the in-plane image 10 corresponding to that point is measured at the common point and assigned to the cell. This can be achieved through direct measurement of the grayscale image at that point (as illustrated in FIG. 2), or the value can be interpolated from the pixels of the grayscale image using various image sampling techniques.

In FIG. 2, the pixels of the grayscale in-plane image 10 are smaller than the cells of the tiling 16. The pixels of the grayscale in-plane image, however, can be larger than the cells. As will be readily appreciated by those skilled in the art, in the latter case, it may be advantageous to use an interpolation method or technique for sub-sampling the pixels.

Each cell is then assigned a number which represents the determined level of grayscale and which falls within the selected numerical range (e.g., 0-1). This assigned number is referred to as the cell's grayscale value.

Control Patterns of Icons

As previously noted, the coextensive control patterns of icons are contained on or within the in-plane image(s) forming an icon layer, with each control pattern containing icons mapped to areas of the in-plane image that fall within a range of grayscale levels (e.g., a grayscale level between 0 (black) and 0.1667).

Once each cell in the tiling 16 has been assigned a grayscale value (and accordingly each possible grayscale value has been determined), a control pattern probability distribution is specified, which serves to assign a range of random numbers to each control pattern. Each cell is then provided with a random number that falls with the selected numerical range (e.g., 0-1) using a RNG.

Once a cell's random number is selected and the grayscale value of that cell is known, a particular control pattern for that particular cell can be assigned. The control pattern probability distribution effectively sets the probability that a particular control pattern in the control pattern palette will be used to fill a particular cell.

Figure 3:
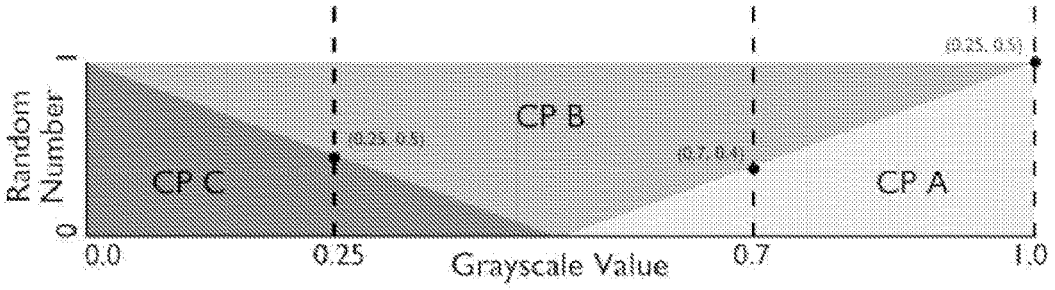
FIG. 3 illustrates an example of a control pattern probability distribution with vertical overlap between the control patterns in the distribution in which the random numbers are chosen between 0 and 1 and the grayscale values range from 0.0 to 1.0.

An example of a control pattern distribution is shown in FIG. 3. In this example, three different control patterns are in the control pattern palette (Control Pattern A (CP A), Control Pattern B (CP B), Control Pattern C (CP C)), with each control pattern occupying its own triangular region in the control pattern distribution. Each possible grayscale value is mapped to a vertical cross section of this distribution. The vertical cross section showing which random numbers correspond to which control pattern.

By way of example, for a cell whose grayscale value is 1.0, this would correspond to a point along the distribution where the probability that Control Pattern A should be chosen is 100%, the probability that Control Pattern B should be chosen is 0%, and the probability that Control Pattern C should be chosen is 0%. This is because all of the random numbers between 0 and 1 will correspond to control pattern A.

By way of further example, for a cell whose grayscale value is 0.7, a random number chosen between 0 and 0.4 will correspond to that particular cell being filled with Control Pattern A, while a random number chosen between 0.4 and 1.0 will correspond to that particular cell being filled with Control Pattern B. There is no possibility for this cell to be filled with Control Pattern C.

By way of yet a further example, for a cell whose grayscale value is 0.25, a random number between 0 and 0.5 will correspond to that particular cell being filled with Control Pattern C, while a random number chosen between 0.5 and 1.0 will correspond to that particular cell being filled with Control Pattern B. In other words, there is a 50% probability that the cell will be filled with Control Pattern C and a 50% probability that the cell will be filled with Control Pattern B.

There is no practical limit on the definition of the control pattern probability distribution, which is simply a mathematical construct that connects a random number to the choice of control pattern. The control pattern distribution can adjust many different aspects of the dynamic optical effects of the subject invention, such as, for example, more rapid or slower transition between control patterns, and multiple control patterns visible simultaneously. In addition, and as alluded to above, different portions of the in-plane image may have different control pattern distributions and different collections or palettes of control patterns. This would allow some portions of the in-plane image to be activated with left-right tilting, while other portions are activated with towards-away tilting, and yet other portions to be activated regardless of the direction of tilt. In the present exemplary embodiment, the primary purpose of the control pattern distribution is to automatically 'dither' or smooth the boundaries between the parts of the grayscale image that would be filled with different control patterns of icons. Because the control pattern distribution provides a probabilistic means by which the control patterns of icons are chosen, the areas of the in-plane image that are assigned to a given control pattern need not be sharply defined. Instead, there can be smooth transition from one control pattern's area to the next.

Figure 4:
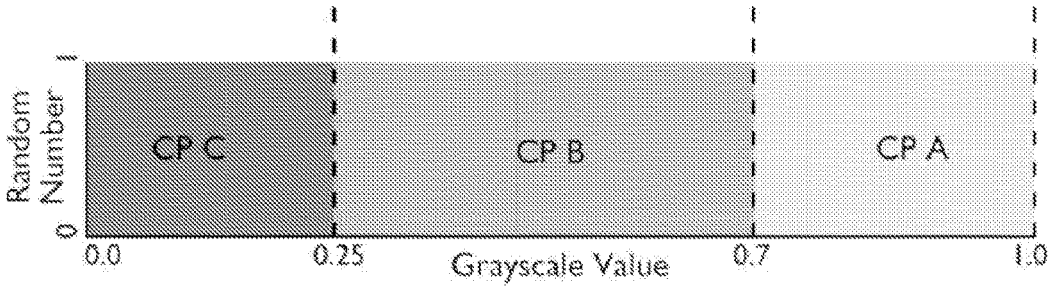
FIG. 4 illustrates an example of a control pattern probability distribution with no vertical overlap between the control patterns in the distribution in which the random numbers are again chosen between 0 and 1 and the grayscale values again range from 0.0 to 1.0.

Sharp boundaries can, however, be made to exist through proper definition of the control pattern probability distribution. A control pattern distribution that would provide sharp transition from one control pattern to the next is shown in FIG. 4. Because there is no vertical overlap between the Control Pattern regions in this distribution, the random numbers essentially play no role in the selection of the control patterns. That being said, any grayscale value from 0.0 to 0.25 would result in that cell being filled with Control Pattern C, any grayscale value from 0.25 to 0.7 would result in that cell being filled with Control Pattern B, and any grayscale value from 0.7 to 1.0 would result in that cell being filled with Control Pattern A.

The next step in the inventive method for forming an icon layer of an optical security device is filling each cell with its determined control pattern of icons.

As previously indicated, the dynamic effects of the synthetically magnified images generated by the inventive optical security device are controlled and choreographed by the control patterns of icons. More specifically, the choreography of these images is prescribed by the relative phasing of the control patterns and by the control pattern distribution, in addition to the nature of the grayscale in-plane image.

Figure 5:
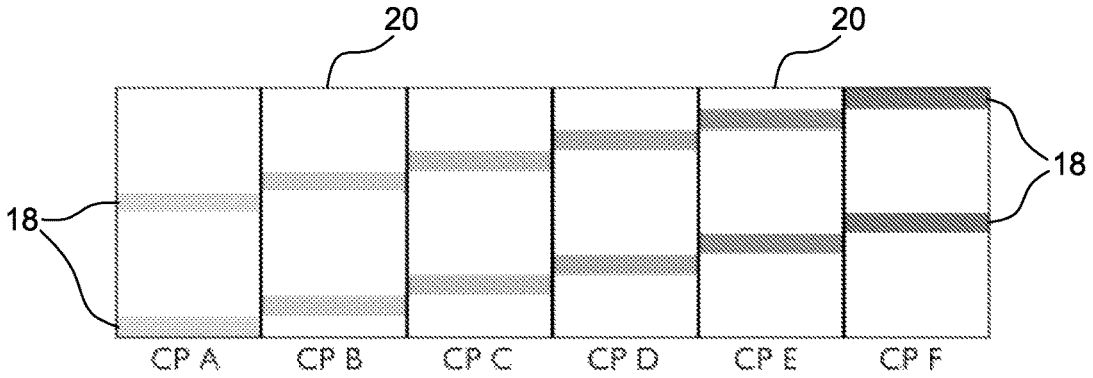
FIG. 5 illustrates a collection of six control patterns of grayscale icons that are each contained in separate contiguous rectangular tiles, while in FIG. 7, these six control patterns are shown overlaid onto the same tile.

Referring now to FIG. 5, a collection of six (6) control patterns, each made up of different gray-toned icons in the form of horizontal lines 18, is shown for illustrative purposes. The bold black outlines 20 represent the tile which would be used to repeat (tessellate) the control patterns of icons on a plane. The tiles for these six control patterns, which define the manner in which the control patterns are tessellated onto a plane, happen to be the same rectangular shape. The tiles, however, as noted above, can adopt any shape that forms a tessellation. The tiles shown in FIG. 5 also have the same dimensions. The tiles are 'in phase' in the sense that they meet up along the same grid. This ensures that, when the control patterns are distributed on or within the in-plane image, the relative timing of when the control patterns are 'activated' remains constant.

Figure 6:
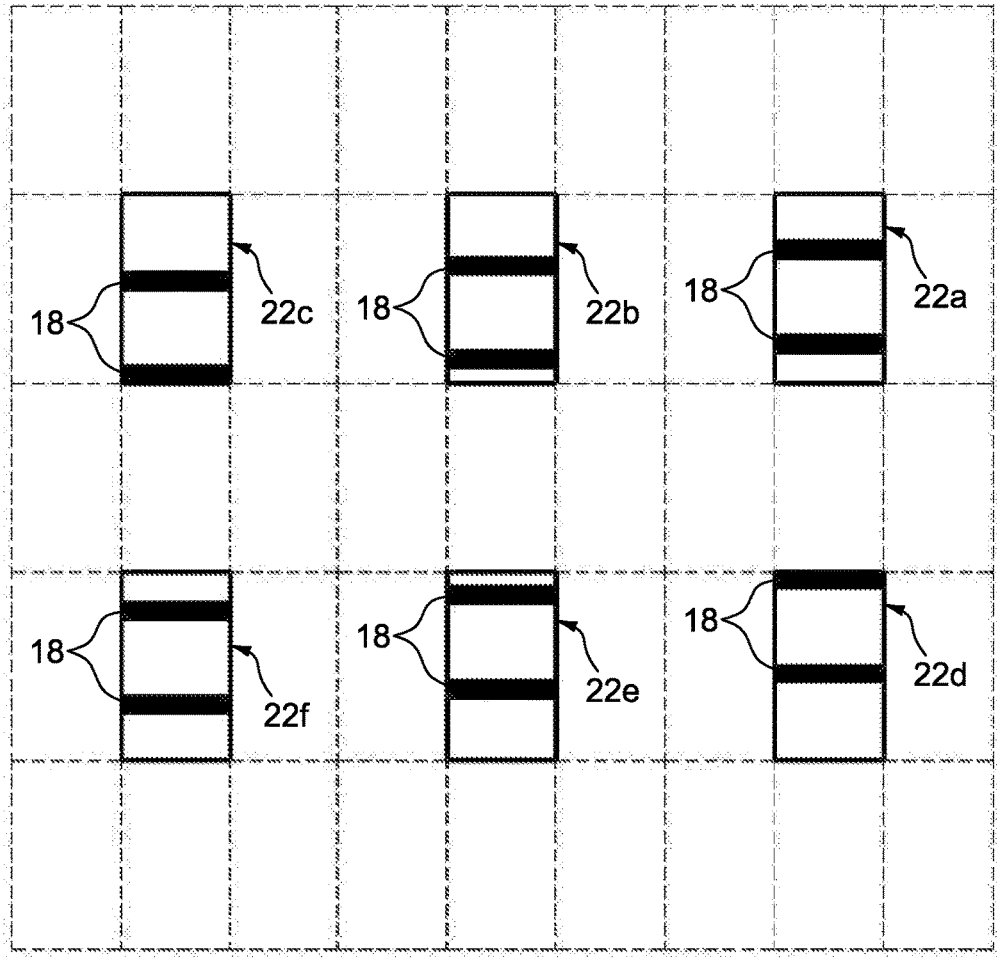
FIG. 6 illustrates a tessellated collection of six coextensive (intermingled) control patterns of icons.

As shown in FIG. 5 and also in FIG. 6 (where six control patterns 22*a-f* are shown tessellated onto a plane), the icons in each control pattern are shifted relative to the icons in other control patterns. The icons may be very slightly shifted up by a few hundred nanometers or slightly more dramatically shifted by a few microns. For control patterns of icons in the form of vertical lines, the icons in each control pattern could be shifted left-right or right-left, while for control patterns of icons in the form of diagonal lines, the icons in each control pattern could be shifted along the diagonal.

It is noted here that there are numerous other ways of coordinating the control patterns to each other. For example, the control patterns could have an intentionally coordinated 'starting point' and fall along different grids.

While six (6) control patterns are shown in FIGS. 5 and 6, the number of control patterns used in the present invention is not so limited. In fact, the number of control patterns of icons could be of infinite number and variety if they are generated mathematically.

Figure 7:
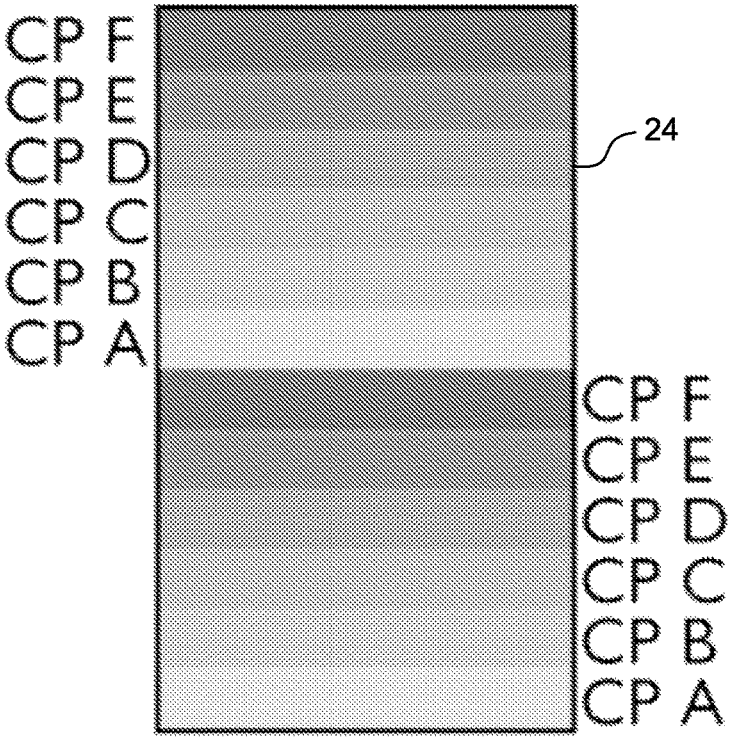

Referring now to FIG. 7, the six control patterns in FIG. 5 are shown overlaid onto the same tile 24. Here, the control patterns A-F are shown 'doubled' in the rectangular tile 24 because this tile is sized to several focusing elements. In one contemplated embodiment, each tile is sized to two focusing elements with hexagonal base diameters. In other words, each tile is in the shape of a rectangular box that represents two hexagons. There is no loss of generality to consider a tile to be a group of control patterns of icons, and the use of rectangular tilings as opposed to hexagonal tilings may make tessellation and algorithms easier to work with.

The collective group of all of the control patterns shown in FIG. 7 completely and evenly covers the tile 24. The idea that the control patterns 'completely and evenly' cover the tile, however, is not meant to be limiting. For example, depending on the desired effect, the collective group of all of the control patterns may only partially cover the tile, or may cover the tile multiple times (i.e., several control patterns occupy the same space on the tile).

Figure 8:
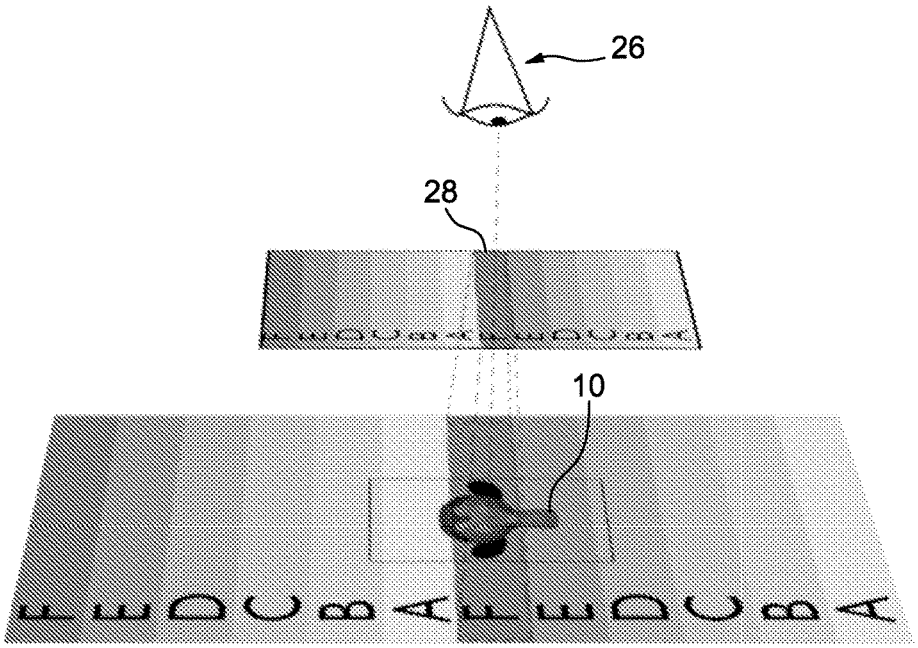
FIGS. 8 and 9 both illustrate the intersection of a grayscale in-plane image with synthetically magnified images generated by the control patterns of icons.
Figure 9:
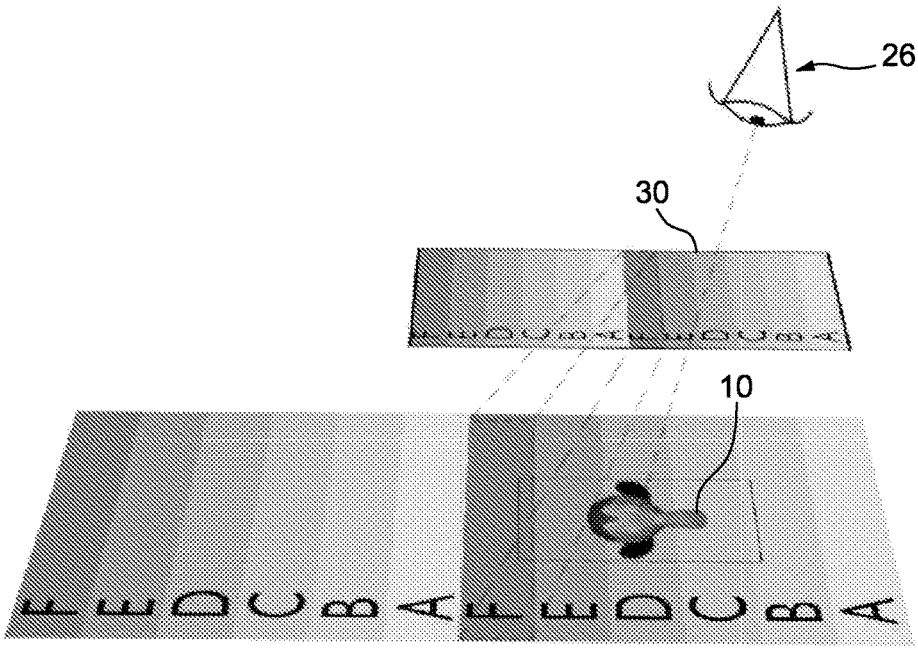

In FIGS. 8 and 9, the intersection of the grayscale in-plane image 10 with a synthetically magnified image generated by a control pattern of icons is shown. In the illustrations shown in these figures, the synthetic images are depicted as small rectangles floating above the surface of this exemplary embodiment of the inventive optical security device. The surface of the inventive device carries the grayscale in-plane image 10. Where the synthetic images generated by the control patterns of icons can be thought of as being projected onto the surface of the inventive device, they are also shown in these figures as lying on the surface of the device. The intersection of the in-plane image 10 and the synthetic image, along with the control pattern distribution, determines what a viewer 26 will actually see. In both of these exemplary embodiments, as the inventive optical security device is tilted towards-away from the viewer, the collective focal points of the focusing elements will effectively shift upward and downward. This means that the intersection of a synthetic image with the in-plane image 10 will shift accordingly so that the synthetic image from a new contributing control pattern will highlight the in-plane image. For example, in FIG. 8, the viewer 26 sees the intersection of the synthetic image 28 formed by Control Pattern F with the middle of the in-plane image 10, while in FIG. 9, the viewer 26, now looking from a different angle, sees the intersection of the synthetic image 30 formed by control pattern D with the middle of the in-plane image 10.

Because the synthetic images shown in FIGS. 8 and 9, completely cover the in-plane image 10, there will always be portions of the in-plane image 10 that are visible or 'turned on', no matter what viewing angle. Additionally, the slight ghost images of the synthetic images that remain visible because of light scattered through or around the focusing optics (as mentioned above) will help outline the in-plane image as a whole so that the coherent in-plane image is always visible.

In FIGS. 10 and 11, examples of control pattern distributions, and the resulting images that a viewer would see, are shown.

Figure 10A:
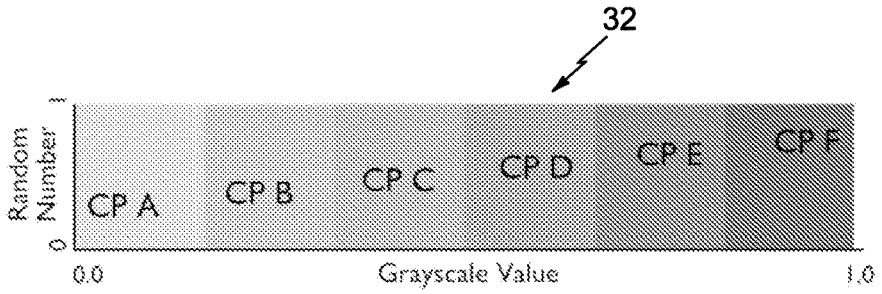
FIGS. 10 and 11 illustrate different control pattern distributions (FIGS. 10A and 11A), and the resulting images that a viewer would see (FIGS. 10B and 11B)
Figure 10B:
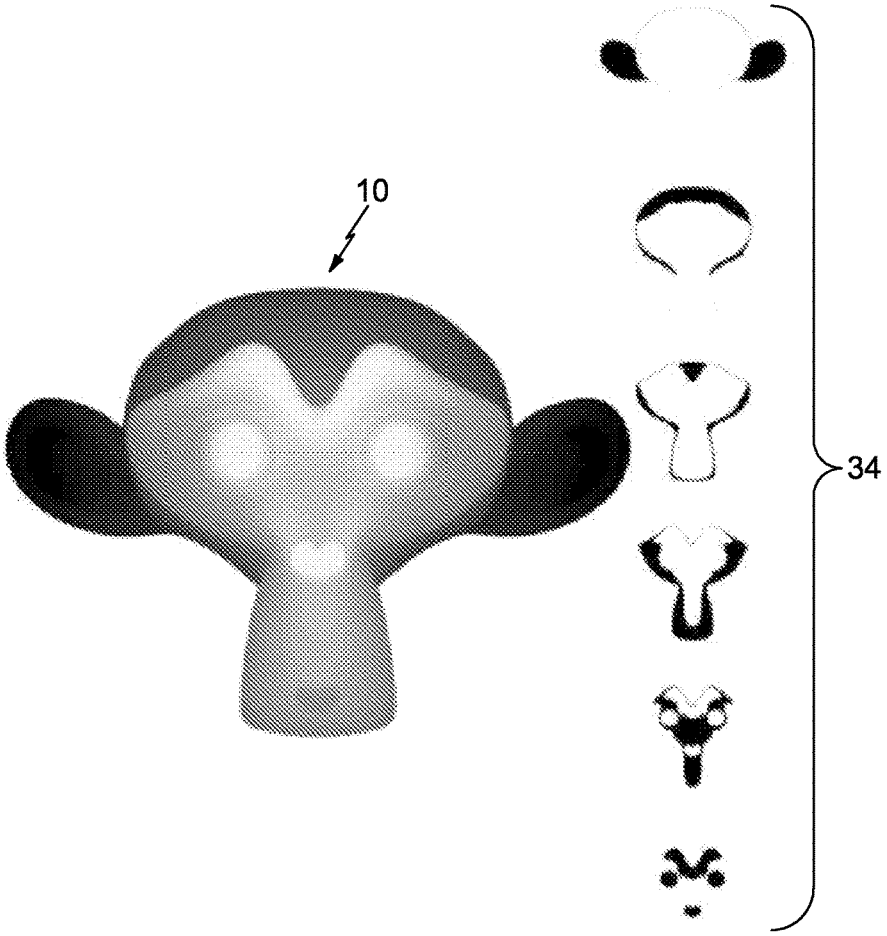

The control pattern distribution 32 shown in FIG. 10A is a "hard transition" control pattern distribution, which as alluded to above, results in sharp transitions between the synthetic images generated by the control patterns of icons. In FIG. 10B, the grayscale image 10 is shown for reference purposes along with a collection of views 34 of the intersection between the control patterns' synthetic images and the in-plane image.

Figure 11A:
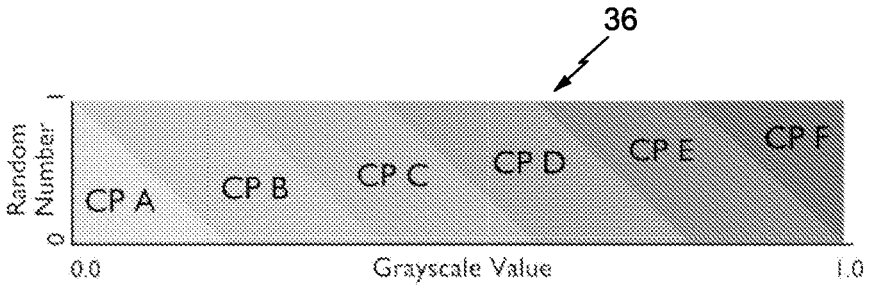
Figure 11B:
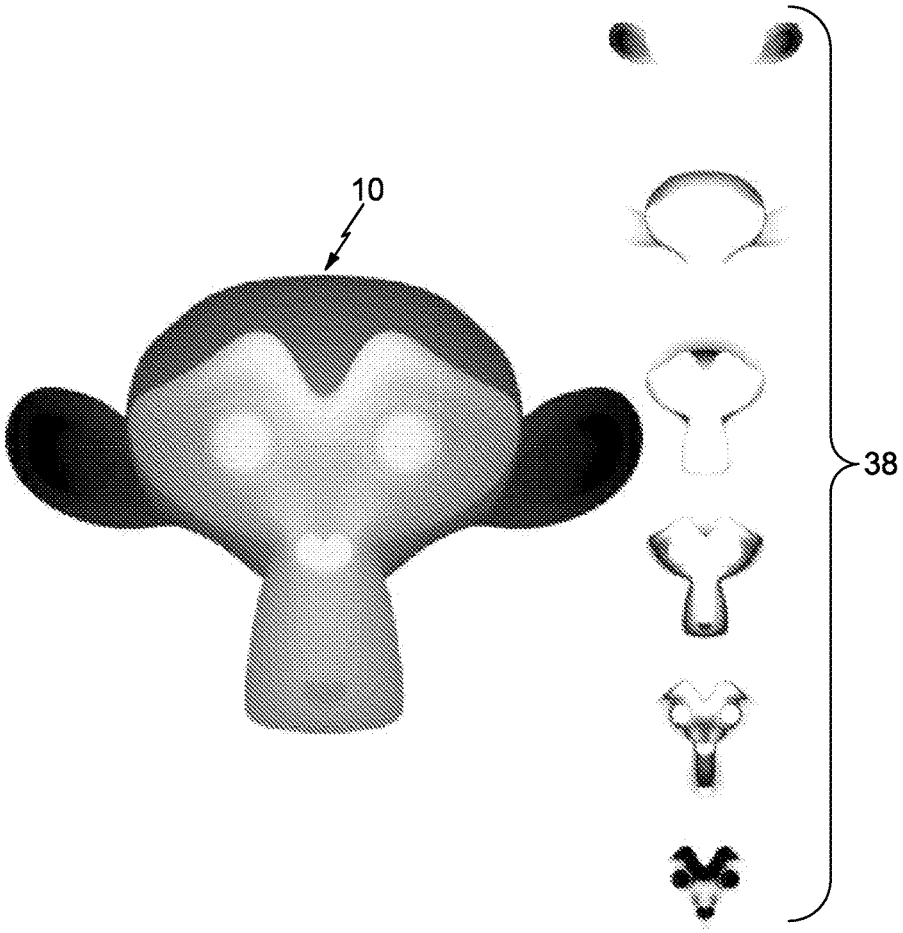

The control pattern distribution 36 shown in FIG. 11A is a "soft transition" control pattern distribution, which as also alluded to above, results in smooth transitions between the synthetic images generated by the control patterns of icons. In FIG. 11B, the grayscale in-plane image 10 is shown for reference purposes along with a collection of views 38 of the intersection between the control patterns' synthetic images and the in-plane image.

In FIGS. 10 and 11, the synthetic images formed by Control Pattern F, when intersected with the grayscale in-plane image 10, will yield a version of the monkey face with highlighted ears. This is because the ears represent the darkest parts of this grayscale in-plane image and the control pattern distribution has its darkest grayscale values associated with Control Pattern F.

Referring to the 'frames' of the animation offered by these exemplary embodiments of the inventive optical security device, which are shown in FIGS. 10B and 11B, it will be seen that the use of a 'hard transition' control pattern distribution results in a 'hard boundary' between the different control pattern contributions to the in-plane image as a whole, while the use of a 'soft transition' control pattern distribution results in 'soft boundary' contributions to the in-plane image as a whole. In both embodiments, the viewer will see sweeping elevations rolling over a surface shaped like the in-plane image (i.e., a monkey's face).

As is evident from the above discussion, the dynamic optical effects demonstrated by the present invention are determined by the relative phasing of the control patterns and by the control pattern distribution, in addition to the nature of the grayscale in-plane image.

Figure 12:
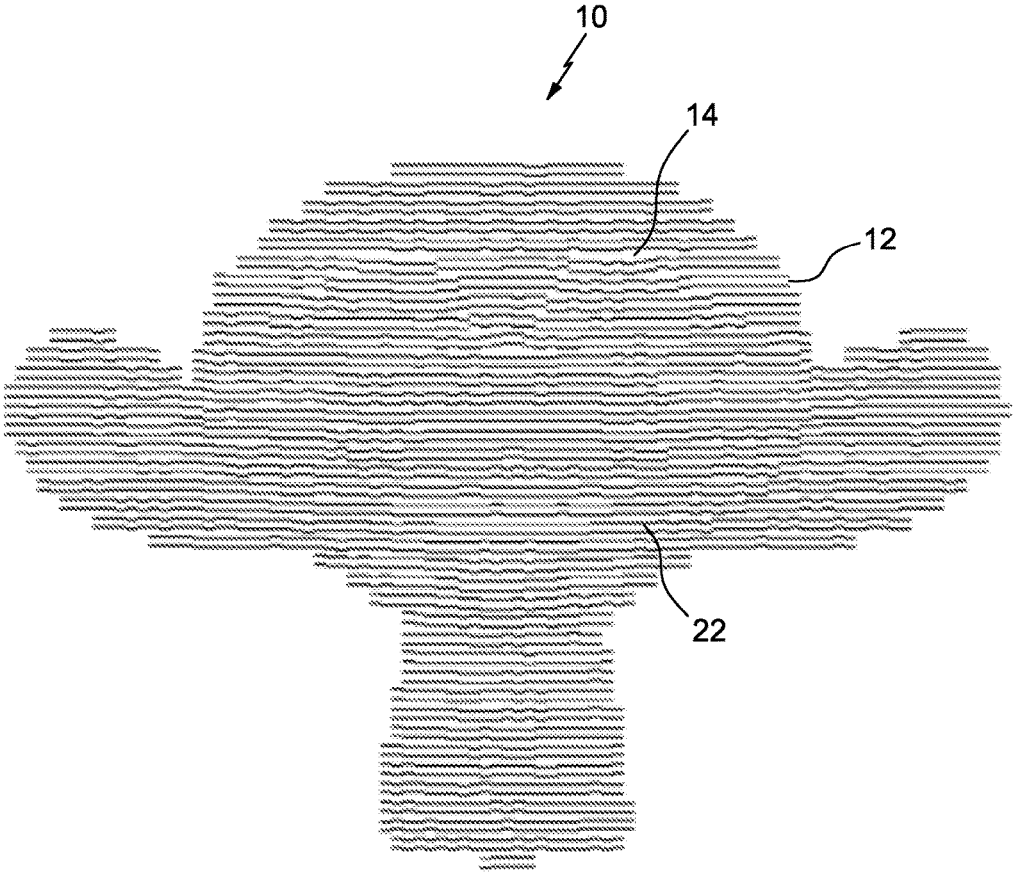
FIG. 12 illustrates the grayscale in-plane image shown in FIG. 1A 'filled' with the control patterns of icons shown in FIG. 6.
Figure 13:
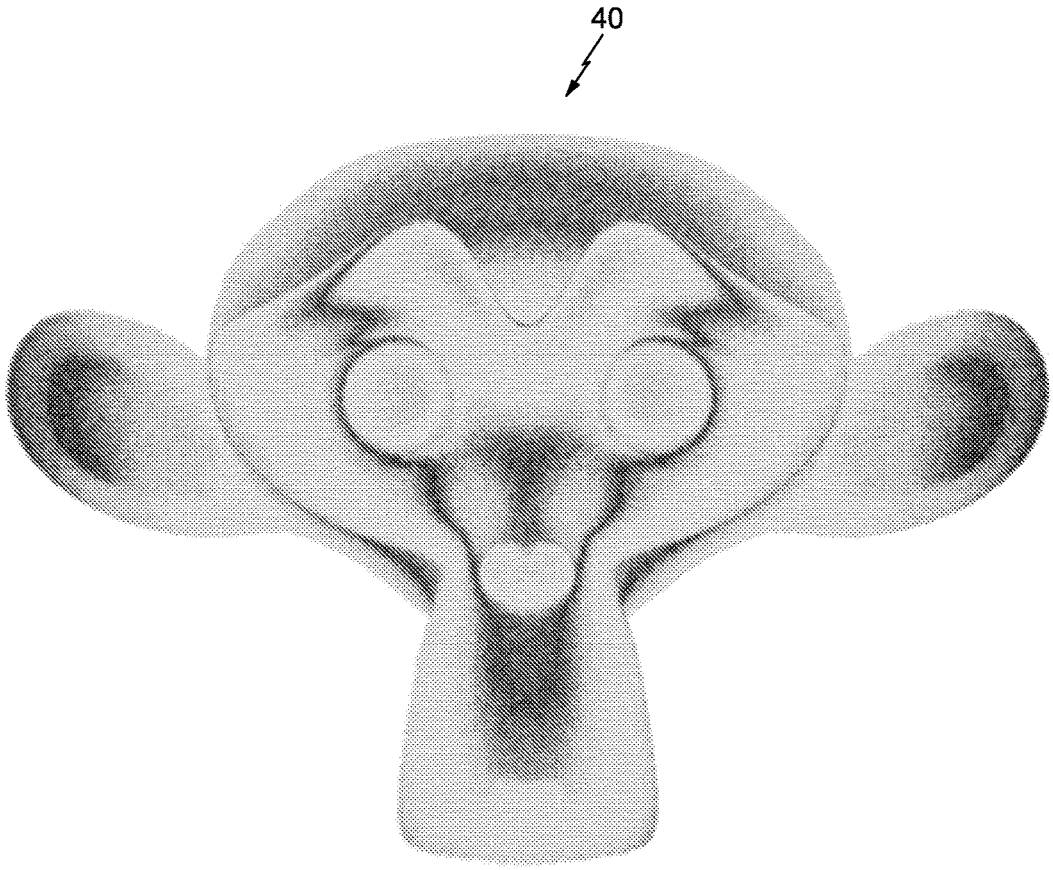
FIG. 13 illustrates one of the images (without dynamic optical effects) viewable from a surface of an exemplary embodiment of the inventive optical security device that employs the 'filled' in-plane image shown in FIG. 12.

In FIG. 12, the in-plane image 10 is shown 'filled' with the six (6) control patterns of icons shown in FIG. 6. In FIG. 13, one of the images (without dynamic optical effects) 40 viewable from a surface of the inventive optical security device employing the 'filled' in-plane image shown in FIG. 12, is illustrated.

In another exemplary embodiment of the inventive optical security device, more than one grayscale image is used, which allows for the animation of the synthetically magnified images. In this embodiment, each grayscale image is assigned a column, or "set" of control patterns of icons. The method for forming the icon layer in this exemplary embodiment is described above, with the selection of control patterns of icons being carried out for each grayscale image simultaneously, forming an overlay of the results of a plurality of grayscale images.

Figure 14:
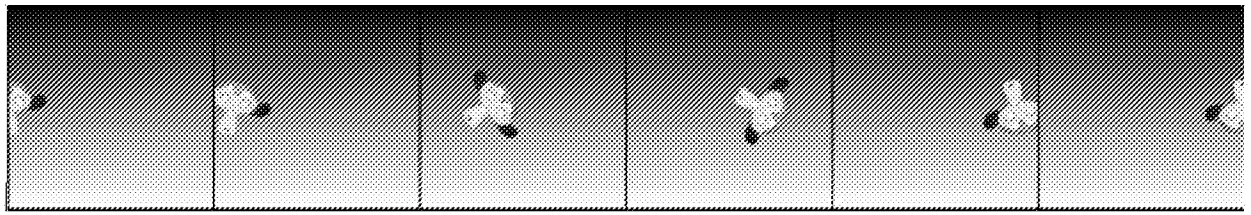
FIG. 14 illustrates a collection of six grayscale images that form an animation.
Figure 15:
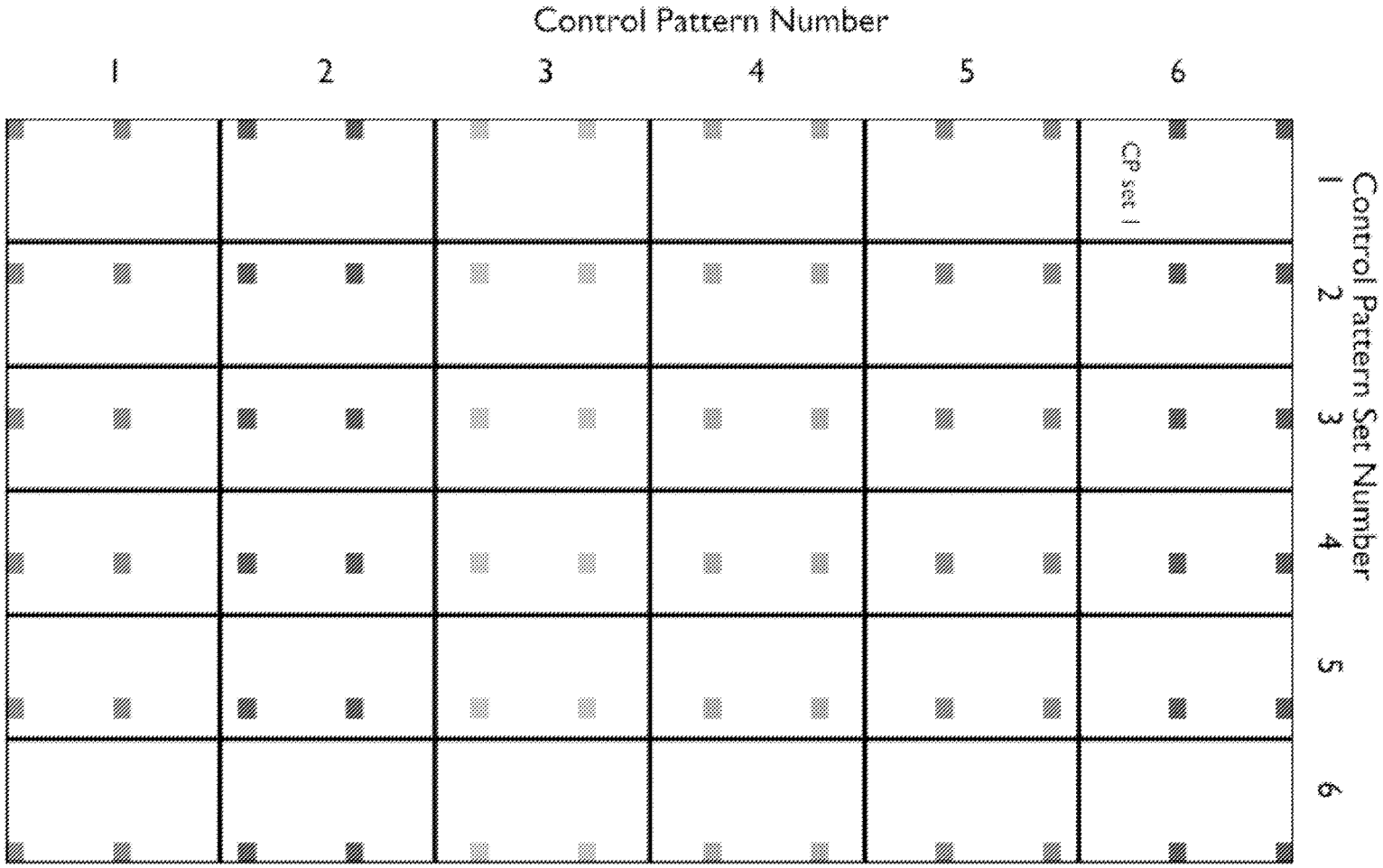
FIG. 15 illustrates a stage in the formation of an icon layer used to produce the animation shown in FIG. 14, which has six sets of control patterns of icons (as columns), each containing six control patterns of icons (as rows).

In the example shown in FIGS. 14 and 15, a collection of six grayscale images form an animation. As best shown in FIG. 15, the control patterns within the same "set" have variation in the vertical direction. That means that, for a given set (or, similarly, for a given grayscale image), tilting in the vertical direction will have the effect of rolling the color through the image in a choreography described by that set's control pattern probability distribution. Corresponding control patterns in adjacent sets have variation in the horizontal direction. That means that tilting in the horizontal direction will have the effect of changing the grayscale image and can produce the effect of an animation.

In this example, the sets of control patterns of icons can be coordinated such that there is one effect when the device is tilted towards-away (due to the variation within a set of control patterns of icons) and a different effect when the device is tilted right-left or left-right (due to the variation among the sets of control patterns of icons).

Generally speaking, there is no limit to the number of sets of control patterns of icons (equivalently the number grayscale in-plane images), or the number of control patterns within the set. This is due to the fact that the variation within either the horizontal or vertical direction can be continuous and can be based off of the continuum of time (for "frames" of animation), or the continuum of grayscale (equivalently, the real numbers on a range (e.g., [0,1])).

Although not a required feature, the icons shown and described herein are rather simple in design, adopting the shape of simple geometric shapes (e.g., circles, dots, squares, rectangles, stripes, bars, etc.) and lines (e.g., horizontal, vertical, or diagonal lines).

The icons may adopt any physical form and in one exemplary embodiment are microstructured icons (i.e., icons having a physical relief). In a preferred embodiment the microstructured icons are in the form of:

(a) optionally coated and/or filled voids or recesses formed on or within a substrate. The voids or recesses each measure from about 0.01 to about 50 microns in total depth; and/or (b) shaped posts formed on a surface of a substrate, each measuring from about 0.01 to about 50 microns in total height.

In one such embodiment, the microstructured icons are in the form of voids or recesses in a polymeric substrate, or their inverse shaped posts, with the voids (or recesses) or regions surrounding the shaped posts optionally filled with a contrasting substance such as dyes, coloring agents, pigments, powdered materials, inks, powdered minerals, metal materials and particles, magnetic materials and particles, magnetized materials and particles, magnetically reactive materials and particles, phosphors, liquid crystals, liquid crystal polymers, carbon black or other light absorbing materials, titanium dioxide or other light scattering materials, photonic crystals, non-linear crystals, nanoparticles, nanotubes, buckeyballs, buckeytubes, organic materials, pearlescent materials, powdered pearls, multilayer interference materials, opalescent materials, iridescent materials, low refractive index materials or powders, high refractive index materials or powders, diamond powder, structural color materials, polarizing materials, polarization rotating materials, fluorescent materials, phosphorescent materials, thermochromic materials, piezochromic materials, photochromic materials, tribolumenscent materials, electroluminescent materials, electrochromic materials, magnetochromic materials and particles, radioactive materials, radioactivatable materials, electret charge separation materials, and combinations thereof. Examples of suitable icons are also disclosed in U.S. Pat. No. 7,333,268 to Steenblik et al., U.S. Pat. No. 7,468,842 to Steenblik et al., and U.S. Pat. No. 7,738,175 to Steenblik et al., all of which, as noted above, are fully incorporated by reference as if fully set forth herein.

The icon layer of the inventive optical security device may have one or more layers of metallization applied to an outer surface thereof. The resulting effect is like an anisotropic lighting effect on metal, which may be useful for select applications.

Icon Focusing Elements

The optionally embedded array of icon focusing elements is positioned to form at least one synthetically magnified image of at least a portion of the icons in each coextensive control pattern of icons. As the optical security device is tilted the synthetically magnified image of the in-plane image appears to have one or more dynamic optical effects (e.g., dynamic bands of rolling color running through it, growing concentric circles, rotating highlights, strobe-like effects). Upon proper placement of an icon focusing element array over the 'filled' in-plane image, one or more synthetically magnified images are projected, the dynamic optical effects of which are controlled and choreographed by the control patterns of icons.

The icon focusing elements used in the practice of the present invention are not limited and include, but are not limited to, cylindrical and non-cylindrical refractive, reflective, and hybrid refractive/reflective focusing elements.

In an exemplary embodiment, the focusing elements are non-cylindrical convex or concave refractive microlenses having a spheric or aspheric surface. Aspheric surfaces include conical, elliptical, parabolic, and other profiles. These lenses may have circular, oval, or polygonal (e.g., hexagonal, substantially hexagonal, square, substantially square) base geometries, and may be arranged in regular, irregular, or random, one- or two-dimensional arrays. In a preferred embodiment, the microlenses are aspheric concave or convex lenses having polygonal (e.g., hexagonal) base geometries that are arranged in a regular, two-dimensional array on a substrate or light-transmitting polymer film.

The focusing elements, in one such exemplary embodiment, have preferred widths (in the case of cylindrical lenses) and base diameters (in the case of non-cylindrical lenses) of less than or equal to 1 millimeter including (but not limited to) widths/base diameters: ranging from about 200 to about 500 microns; and ranging from about 50 to about 199 microns, preferred focal lengths of less than or equal to 1 millimeter including (but not limited to) the sub-ranges noted above, and preferred f-numbers of less than or equal to 10 (more preferably, less than or equal to 6. In another contemplated embodiment, the focusing elements have preferred widths/base diameters of less than about 50 microns (more preferably, less than about 45 microns, and most preferably, from about 10 to about 40 microns), preferred focal lengths of less than about 50 microns (more preferably, less than about 45 microns, and most preferably, from about 10 to about 30 microns), and preferred f-numbers of less than or equal to 10 (more preferably, less than or equal to 6). In yet another contemplated embodiment, the focusing elements are cylindrical or lenticular lenses that are much larger than the lenses described above with no upper limit on lens width.

As alluded to above, the array of icon focusing elements used in the inventive optical security device may constitute an array of exposed icon focusing elements (e.g., exposed refractive microlenses), or may constitute an array of embedded icon focusing elements (e.g., embedded microlenses), the embedding layer constituting an outermost layer of the optical security device.

Optical Separation

Although not required by the present invention, optical separation between the array of focusing elements and the control patterns of icons may be achieved using one or more optical spacers. In one such embodiment, an optical spacer is bonded to the focusing element layer. In another embodiment, an optical spacer may be formed as a part of the focusing element layer, an optical spacer may be formed during manufacture independently from the other layers, or the thickness of the focusing element layer increased to allow the layer to be free standing. In yet another embodiment, the optical spacer is bonded to another optical spacer.

The optical spacer may be formed using one or more essentially colorless materials including, but not limited to, polymers such as polycarbonate, polyester, polyethylene, polyethylene napthalate, polyethylene terephthalate, polypropylene, polyvinylidene chloride, and the like.

In other contemplated embodiments of the present invention, the optical security device does not employ an optical spacer. In one such embodiment, the optical security device is an optionally transferable security device with a reduced thickness ("thin construction"), which basically comprises an icon layer substantially in contact with an array of optionally embedded icon focusing elements.

Method of Manufacture

The inventive optical security device may be prepared (to the extent not inconsistent with the teachings of the present invention) in accordance with the materials, methods and techniques disclosed in U.S. Pat. No. 7,333,268 to Steenblik et al., U.S. Pat. No. 7,468,842 to Steenblik et al., U.S. Pat. No. 7,738,175 to Steenblik et al., and U.S. Patent Application Publication No. 2010/0308571 A1 to Steenblik et al., all of which are fully incorporated herein by reference as if fully set forth herein. As described in these references, arrays of focusing elements and image icons can be formed from a variety of materials such as substantially transparent or clear, colored or colorless polymers such as acrylics, acrylated polyesters, acrylated urethanes, epoxies, polycarbonates, polypropylenes, polyesters, urethanes, and the like, using a multiplicity of methods that are known in the art of micro-optic and microstructure replication, including extrusion (e.g., extrusion embossing, soft embossing), radiation cured casting, and injection molding, reaction injection molding, and reaction casting. High refractive index, colored or colorless materials having refractive indices (at 589 nm, 20° C.) of more than 1.5, 1.6, 1.7, or higher, such as those described in U.S. Patent Application Publication No. US 2010/0109317 A1 to Hoffmuller et al., may also be used. As also described, embedding layers can be prepared using adhesives, gels, glues, lacquers, liquids, molded or coated polymers, polymers or other materials containing organic or metallic dispersions, etc.

As noted above, the optical security device of the present invention may be used in the form of sheet materials and base platforms that are made from or employ the inventive optical security device, as well as documents made from these materials. For example, the inventive device may take the form of a security strip, thread, patch, overlay, or inlay that is mounted to a surface of, or at least partially embedded within a fibrous or non-fibrous sheet material (e.g., banknote, passport, ID card, credit card, label), or commercial product (e.g., optical disks, CDs, DVDs, packages of medical drugs). The inventive device may also be used in the form of a standalone product, or in the form of a non-fibrous sheet material for use in making, for example, banknotes, passports, and the like, or it may adopt a thicker, more robust form for use as, for example, a base platform for an ID card, high value or other security document.

In one such exemplary embodiment, the inventive device is a micro-optic film material such as an ultra-thin, sealed lens structure for use in banknotes, while in another such exemplary embodiment; the inventive device is a sealed lens polycarbonate inlay for base platforms used in the manufacture of plastic passports.

While various embodiments of the present invention have been described above it should be understood that they have been presented by way of example only, and not limitation. Thus, the breadth and scope of the present invention should not be limited by any of the exemplary embodiments.

What is claimed is:

1. An optical security device, which comprises:

an array of icon focusing elements, wherein the focusing elements are non-cylindrical refractive, reflective, or hybrid refractive/reflective focusing elements;

at least one grayscale in-plane image that has a boundary and an image area within the boundary that visually lies substantially in a plane of a substrate on which the in-plane image is carried; and a plurality of coextensive control patterns of icons contained on or within the at least one in-plane image forming an icon layer, each control pattern being mapped to areas of the in-plane image having a range of grayscale levels, wherein placement of the control patterns of icons within the in-plane image is determined using one or more control pattern probability distributions associated with each grayscale level within all or part of the in-plane image, wherein the array of icon focusing elements is positioned to form at least one synthetically magnified image of at least a portion of the icons in each coextensive control pattern of icons, the at least one synthetically magnified image, which intersects with the at least one grayscale in-plane image, having one or more dynamic effects, wherein the one or more dynamic effects of the at least one synthetically magnified image are controlled and choreographed by the control patterns of icons, wherein the choreography of the images is prescribed by the relative phasing of the control patterns and by the control pattern distribution, in addition to the nature of the grayscale in-plane image.

2. The optical security device of claim 1, wherein the array of icon focusing elements is an embedded array of icon focusing elements.

3. The optical security device of claim 1 or 2, wherein the at least one synthetically magnified image is viewable over a range of viewing angles, and wherein a silhouette of the in-plane image is also viewable over this range of viewing angles.

4. The optical security device of claim 1, wherein one or more layers of metallization cover an outer surface of the icon layer.

5. The optical security device of claim 1, which comprises a grayscale in-plane image, a plurality of control patterns of icons contained within the in-plane image thereby forming an icon layer, and an array of icon focusing elements positioned to form at least one synthetically magnified image of the control patterns of icons.

6. The optical security device of claim 1, which comprises a sequence of grayscale in-plane images, a set of control patterns of icons for each in-plane image, wherein each set of control patterns of icons is contained within its respective in-plane image, which together form an icon layer, and an array of icon focusing elements positioned to form an animation of the synthetically magnified images of the control patterns of icons.

7. A method for making the optical security device of claim 1, the method comprising:

(a) providing at least one grayscale in-plane image that has a boundary and an image area within the boundary that visually lies substantially in a plane of a substrate on which the in-plane image is carried;

(b) providing a plurality of coextensive control patterns of icons contained on or within the at least one in-plane image forming an icon layer, each control pattern being mapped to areas of the in-plane image having a range of grayscale levels, wherein placement of the control patterns of icons within the in-plane image is determined using one or more control pattern probability distributions associated with each grayscale level within all or part of the in-plane image;

(c) providing an array of icon focusing elements; and (d) providing the array of icon focusing elements relative to the icon layer so as to form at least one synthetically magnified image of at least a portion of the icons in each coextensive control pattern of icons, the at least one synthetically magnified image, which intersects with the at least one in-plane image, having one or more dynamic effects, wherein the one or more dynamic effects of the at least one synthetically magnified image are controlled and choreographed by the control patterns of icons.

8. A method for forming an icon layer of an optical security device that includes a grayscale in-plane image, wherein the in-plane image has a boundary and an image area within the boundary that visually lies substantially in a plane of the substrate on which the in-plane image is carried, a plurality of control patterns of icons contained within the in-plane image thereby forming an icon layer, and an array of icon focusing elements positioned to form at least one synthetically magnified image of the control patterns of icons, wherein the focusing elements are non-cylindrical refractive, reflective, or hybrid refractive/reflective focusing elements, wherein the synthetically magnified image intersects with the at least one in-plane image, the method comprising: selecting a grayscale in-plane image; and using the grayscale in-plane image to place the control patterns of icons within the in-plane image to together form the icon layer, wherein the choreography of the images is prescribed by the relative phasing of the control patterns and by the control pattern distribution, in addition to the nature of the grayscale in-plane image.

9. The method of claim 8, which comprises:

(a) selecting a grayscale in-plane image and scaling the grayscale image to a size that may be used in the icon layer;

(b) superimposing a tiling onto the scaled grayscale in-plane image, the tiling comprising cells that will contain the control patterns of icons, wherein each cell has a preferred size similar to one or several focusing elements;

(c) selecting a numerical range to represent the colors black and white and various levels of gray in between black and white;

(d) determining the level of grayscale of the scaled grayscale in-plane image in each cell of the superimposed tiling;

(e) assigning to each cell a number which represents the determined level of grayscale and which falls within the selected numerical range, wherein the assigned number is the cell's grayscale value;

(f) selecting a number of control patterns of icons for use in a control pattern palette, and for each control pattern of icons, assigning a range of grayscale levels which fall within the selected numerical range;

(g) specifying a control pattern probability distribution within the in-plane image and for each possible grayscale value, using the control patter probability distribution to assign a range of random numbers to each control pattern;

(h) providing each cell in the tiling with a random number that falls with the selected numerical range using a random number generator;

(i) determining which control pattern will be used to fill each cell using the cell's grayscale value and the cell's random number in conjunction with a mathematical construct which corresponds to the control pattern probability distribution; and (j) filling each cell with its determined control pattern of icons.

10. A method for forming an icon layer of an optical security device that includes a sequence of grayscale in-plane images, wherein the in-plane image has a boundary and an image area within the boundary that visually lies substantially in a plane of the substrate on which the in-plane image is carried, a set of control patterns of icons for each in-plane image where each set of control patterns of icons is contained within its respective in-plane image together forming an icon layer, and an array of icon focusing elements positioned to form an animation of synthetically magnified images of the control patterns of icons, wherein the focusing elements are non-cylindrical refractive, reflective, or hybrid refractive/reflective focusing elements, the synthetically magnified images intersecting with the grayscale in-plane images, the method comprising: selecting a sequence of grayscale in-plane images, selecting a set of control patterns of icons for each grayscale in-plane image wherein the choreography of the images is prescribed by the relative phasing of the control patterns and by the control pattern distribution, in addition to the nature of the grayscale in-plane image; and using the grayscale in-plane images to place its respective control patterns of icons within the in-plane image to form the icon layer.

11. The method of claim 10, which comprises:

(a) selecting a sequence of grayscale in-plane images that form an animation and scaling the grayscale images to a size that may be used in the icon layer;

(b) superimposing a tiling onto each scaled grayscale in-plane image, the tiling comprising cells that will contain the control patterns of icons, wherein each cell has a preferred size similar to one or several focusing elements;

(c) selecting a numerical range to represent the colors black and white and various levels of gray in between black and white;

(d) determining the level of grayscale of the scaled grayscale in-plane image in each cell of the superimposed tiling;

(e) assigning to each cell a number which represents the determined level of grayscale and which falls within the selected numerical range, wherein the assigned number is the cell's grayscale value;

(f) for each grayscale in-plane image that forms the animation, selecting a number of control patterns of icons for use in a control pattern palette, and for each control pattern of icons, assigning a range of grayscale levels which fall within the selected numerical range, wherein the selected number of control patterns of icons constitutes a set of control patterns for the grayscale in-plane image, with each grayscale in-plane image having one set of control patterns of icons;

(g) specifying, for each set of control patterns of icons, a control pattern probability distribution within the respective in-plane image and for each possible grayscale value, using the control pattern probability distribution to assign a range of random numbers to each control pattern;

(h) providing each cell in the tiling with a random number that falls with the selected numerical range using a random number generator;

(i) determining, for each set of control patterns, each set being assigned to a specific and different grayscale image, which control pattern will be used to fill each cell using the cell's grayscale value and the cells random number in conjunction with a mathematical construct which corresponds to the control pattern probability distribution; and (j) filling each cell with its determined control pattern of icons, each cell receiving a determined control pattern from each set of control patterns of icons.

12. A method for increasing design space and reducing blurriness of images formed by an optical security device, the optical security device including at least one grayscale in-plane image, a plurality of control patterns of icons contained within the in-plane image forming an icon layer, and an array of icon focusing elements positioned to form at least one synthetically magnified image of the control patterns of icons, which intersects with the at least one in-plane image, wherein the focusing elements are non-cylindrical refractive, reflective, or hybrid refractive/reflective focusing elements, the method comprising: using at least one grayscale in-plane image, wherein the in-plane image has a boundary and an image area within the boundary that visually lies substantially in a plane of the substrate on which the in-plane image is carried; and using coordinated control patterns of icons on or within each in-plane image to control and choreograph one or more dynamic effects of the synthetically magnified images, wherein the choreography of the images is prescribed by the relative phasing of the control patterns and by the control pattern distribution, in addition to the nature of the grayscale in-plane image.

13. A sheet material that is made from or employs the optical security device of claim 1.

14. A base platform that is made from or employs the optical security device of claim 1.

15. A document made from the sheet material of claim 13, or the base platform of claim 14.

* * * * *